US011047170B2

(12) United States Patent
Wong

(10) Patent No.: US 11,047,170 B2
(45) Date of Patent: Jun. 29, 2021

(54) SLAT ASSEMBLY FOR ROLLER SHUTTER, ROLLER SHUTTER, AND METHODS OF MANUFACTURE THEREOF

(71) Applicant: Gliderol Doors (S) Pte Ltd, Singapore (SG)

(72) Inventor: Lok Yung Wong, Singapore (SG)

(73) Assignee: Gliderol Doors (S) Pte Ltd, Singapore (SG)

( * ) Notice: Subject to any disclaimer, the term of this patent is extended or adjusted under 35 U.S.C. 154(b) by 0 days.

(21) Appl. No.: 16/955,844

(22) PCT Filed: Jan. 30, 2019

(86) PCT No.: PCT/SG2019/050050

§ 371 (c)(1),
(2) Date: Jun. 19, 2020

(87) PCT Pub. No.: WO2019/151945

PCT Pub. Date: Aug. 8, 2019

(65) Prior Publication Data

US 2020/0340296 A1 Oct. 29, 2020

(30) Foreign Application Priority Data

Jan. 31, 2018 (SG) ..... 10201800852V
Jul. 31, 2018 (SG) ..... 10201806540T

(51) Int. Cl.
*E06B 9/15* (2006.01)
*E06B 9/17* (2006.01)
*E06B 9/68* (2006.01)

(52) U.S. Cl.
CPC ..... *E06B 9/15* (2013.01); *E06B 9/17046* (2013.01); *E06B 9/17076* (2013.01); *E06B 9/68* (2013.01);
(Continued)

(58) Field of Classification Search
CPC ..... E06B 9/15; E06B 9/17076; E06B 9/18; E06B 2009/1505; E06B 2009/1516;
(Continued)

(56) References Cited

U.S. PATENT DOCUMENTS 876,593 A * 1/1908 Rush ..... E06B 9/15 160/235
926,139 A * 6/1909 Rush ..... E06B 9/15 160/235
(Continued)

FOREIGN PATENT DOCUMENTS

CN 1090009 7/1994
CN 201318112 9/2009
(Continued)

OTHER PUBLICATIONS

International Search Report dated Apr. 3, 2019 in corresponding PCT/SG2019/050050 filed Jan. 30, 2019, 4 pages.
(Continued)

*Primary Examiner* — Johnnie A. Shablack
(74) *Attorney, Agent, or Firm* — Hovey Williams LLP

(57) ABSTRACT

A slat assembly may include a slat having a first and second receiving portion. The first and second receiving portions being a pair of bent portions forming an acute angle. The slat assembly may further include an insulation layer lined on the slat. The slat assembly may further include a retaining mechanism disposed on the insulation layer to press a first portion of the insulation layer into the first receiving portion of the slat and to press a second portion of the insulation layer into the second receiving portion of the slat such that the retaining mechanism may cooperate with the first and second receiving portions to hold the insulation layer between the retaining mechanism and the slat without puncturing or penetrating the insulation layer with fasteners. A roller shutter including the slat assembly. A method of
(Continued)

manufacturing a slat assembly and a method of manufacturing a roller shutter.

18 Claims, 22 Drawing Sheets

(52) U.S. Cl.
CPC ..... *E06B 2009/1505* (2013.01); *E06B 2009/1544* (2013.01); *E06B 2009/17069* (2013.01)

(58) Field of Classification Search
CPC ..... E06B 2009/1538; E06B 2009/1544; E06B 2009/17069; A62C 2/10
See application file for complete search history.

(56) References Cited

U.S. PATENT DOCUMENTS

| | | | | | |
|---|---|---|---|---|---|
| 994,440 | A * | 6/1911 | Brunst | E06B 9/15 | 160/235 |
| 1,051,598 | A * | 1/1913 | Johnson | E06B 9/15 | 160/235 |
| 1,054,977 | A * | 3/1913 | McCloud | E06B 9/15 | 160/235 |
| 1,437,947 | A * | 12/1922 | Probert | E06B 9/15 | 160/235 |
| 1,643,074 | A * | 9/1927 | Lavagnino | E06B 9/15 | 160/235 |
| 1,872,652 | A * | 8/1932 | Best | E06B 9/115 | 160/232 |
| 1,908,634 | A * | 5/1933 | Kendall | E06B 9/15 | 160/229.1 |
| 2,019,379 | A * | 10/1935 | Anderson | E06B 9/15 | 160/235 |
| 2,099,408 | A * | 11/1937 | Packert | E06B 9/15 | 160/235 |
| 2,301,845 | A * | 11/1942 | Anderson | E06B 9/165 | 160/235 |
| 3,090,430 | A * | 5/1963 | Carlo | E06B 9/13 | 160/196.1 |
| 3,481,388 | A * | 12/1969 | Smart | E06B 3/94 | 160/84.08 |
| 4,470,444 | A * | 9/1984 | Riexinger | E06B 9/15 | 160/235 |
| 4,630,664 | A | 12/1986 | Magro | | |
| 5,419,386 | A | 5/1995 | Magro et al. | | |
| 6,615,894 | B1 * | 9/2003 | McKeon | E05D 15/12 | 160/1 |
| 7,370,682 | B2 * | 5/2008 | Wong | E06B 9/11 | 160/133 |
| 8,365,801 | B1 * | 2/2013 | Motosko | E06B 9/15 | 160/235 |
| 8,443,909 | B2 | 5/2013 | Wong | | |
| 10,435,943 | B2 * | 10/2019 | Rowley | E06B 9/165 | |
| 2011/0108210 | A1 | 5/2011 | Wang | | |
| 2019/0128056 | A1 * | 5/2019 | Miller | E06B 9/165 | |
| 2019/0301237 | A1 * | 10/2019 | Magro | E06B 9/165 | |
| 2019/0390511 | A1 * | 12/2019 | Lambridis | E06B 9/15 | |

FOREIGN PATENT DOCUMENTS

| | | | |
|---|---|---|---|
| CN | 104775737 | | 7/2015 |
| DE | 1203444 | | 10/1965 |
| DE | 1975917 | | 12/1967 |
| DE | 2912774 | A1 | 10/1980 |
| DE | 3444853 | | 6/1986 |
| DE | 20016722 | U1 | 1/2001 |
| DE | 10058166 | A1 | 6/2002 |
| DE | 102011078079 | | 12/2012 |
| EP | 0003728 | | 9/1979 |
| EP | 2894286 | | 7/2015 |
| JP | 62-180189 | | 11/1987 |
| JP | H08-333970 | | 12/1996 |
| JP | H09-268852 | | 10/1997 |
| WO | 2014108064 | | 7/2014 |
| WO | 2015004060 | | 1/2015 |

OTHER PUBLICATIONS

Written Opinion dated Apr. 3, 2019 in corresponding PCT/SG2019/050050 filed Jan. 30, 2019, 6 pages.
International Preliminary Report on Patentability completed Aug. 30, 2019 in corresponding PCT/SG2019/050050 filed Jan. 30, 2019, 11 pages.
Machine Translation of CN201318112, 9 pages.
Machine Translation of CN104775737, 10 pages.
Machine Translation of JPH08-333970, 9 pages.
Machine Translation of DE102011078079, 24 pages.
Machine Translation of DE1975917, 6 pages.
Machine Translation of CN1090009, 8 pages.
Machine translation of DE1203444, 8 pages.
Machine translation of DE3444853, 16 pages.
Machine translation of EP0003728, 7 pages.
Office Action dated Sep. 2, 2020 in corresponding Australian Patent Application Serial No. 2019213465, 7 pages.
DE10058166A1 Machine Translation, 10 pages.
DE2912774A1 Machine Translation, 7 pages.
Office Action dated Jan. 15, 2021 in corresponding Japanese Patent Application No. 2020-542008, 4 pages.
Machine Translation of Office Action dated Jan. 15, 2021 in corresponding Japanese Patent Application No. 2020-542008, 5 pages.
Machine Translation of JPH08333970, 8 pages.
Machine Translation of JPH09268852, 8 pages.

* cited by examiner 900
903
905b
905a
LINTEL BEAM
DOOR HEAD SECTION 900
903
DOOR HEAD SECTION
A
A 900
909
903
907
906
908
901
SECTION A-A

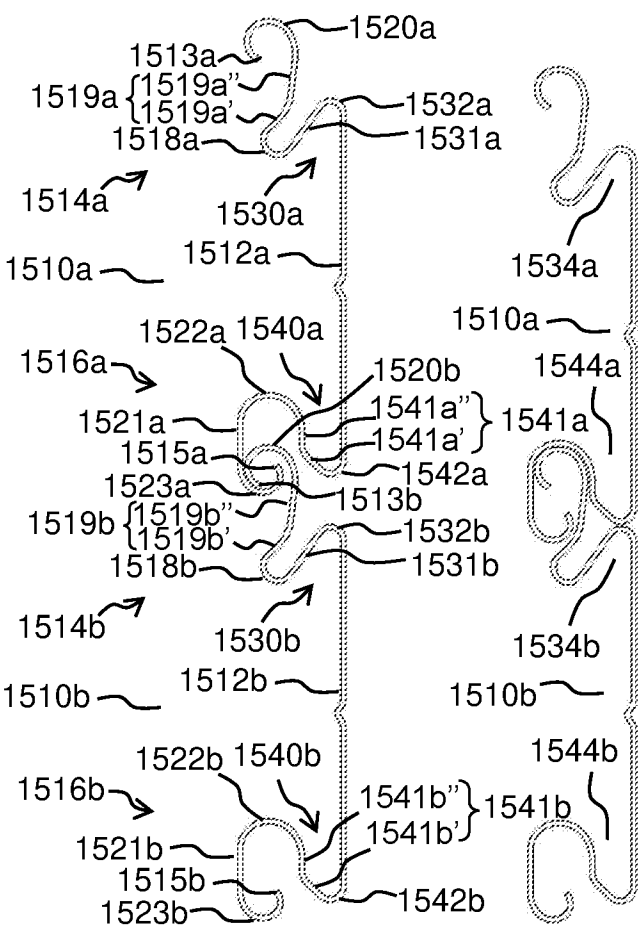
FIG. 15A
FIG. 15B
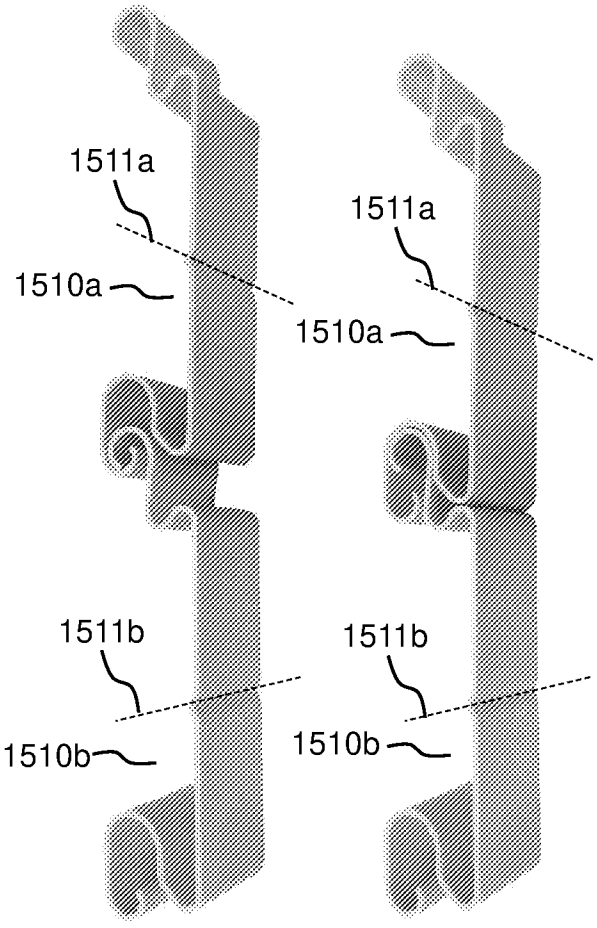
FIG. 15C
FIG. 15D

SLAT ASSEMBLY FOR ROLLER SHUTTER, ROLLER SHUTTER, AND METHODS OF MANUFACTURE THEREOF

RELATED APPLICATIONS

This application claims priority to PCT International Patent Application No. PCT/SG2019/050050 filed Jan. 30, 2019, which claims the priority benefit of Singaporean Patent Application Nos. 10201800852V filed Jan. 31, 2018 and 10201806540T filed Jul. 31, 2018. Each of these three applications is hereby incorporated by reference in their entireties.

TECHNICAL FIELD

Embodiments generally relate to a slat assembly for a roller shutter, a roller shutter, a method of manufacturing a slat assembly, and a method of manufacturing a roller shutter.

BACKGROUND

Roller shutter has been commonly installed at the entrance of various types of premises such as retail shops, warehouses, buildings, hangars, garages, etc. for controlling physical access into the enclosed space of the respective premises. When the shutter curtain of the roller shutter is down, it provides protection against environmental factors such as wind and/or rain. It also provides security protection against intrusion or breaking in. In certain applications, it is also required to act as a fire barrier to impede the spread of fire. Further, according to the fire codes of some countries, these fire shutters in compartment walls are also required to be insulated according to stringent standards. Since most of these shutters are made of metal such as steel which are good conductor of heat, in the event of a fire, while the shutter curtain of the roller shutter may physically prevent the flames from passing through for a period of time, the shutter curtain may not prevent the conduction of the heat which may also quickly lead to the spread of the fire to the other side of the shutter curtain.

In general, a common method of insulating a roller shutter is to place an insulation layer such as an insulation blanket or insulation mat or insulation sheet behind the shutter curtain of the roller shutter. For example, the insulation layer may be customized to the size of the shutter curtain of the roller shutter and be configured to be rolled together with the shutter curtain. To maintain the thermal insulation integrity of the insulation layer, the insulation layer may merely be placed flat against the shutter curtain. However, in such a configuration, the insulation layer may misalign or bulge or tear or over-stretch during rolling and unrolling with the shutter curtain. Accordingly, more recently, it has been proposed to secure the insulation layer to the shutter curtain via rivets or screws puncturing through the insulation layer and to provide additional insulating components to minimize the conduct of heat through the insulation layer via the rivets or screws. However, such configuration is usually complex, is not economical and may require high maintenance to ensure that the insulating components are effective in minimizing the conduct of heat through the insulation layer via the rivets or screws.

SUMMARY

According to various embodiments, there is provided a slat assembly for a roller shutter. The slat assembly may include a slat having a first receiving portion and a second receiving portion. The slat assembly may further include an insulation layer lined on the slat. The first and second receiving portions of the slat may be a pair of bent portions of the slat. Each of the pair of bent portions may form an acute angle. The slat assembly may further include a retaining mechanism disposed on the insulation layer to press a first portion of the insulation layer into the first receiving portion of the slat and to press a second portion of the insulation layer into the second receiving portion of the slat such that the retaining mechanism may cooperate with the first and second receiving portions of the slat to hold the insulation layer between the retaining mechanism and the slat.

According to various embodiments, there is provided a roller shutter. The roller shutter may include a plurality of slats pivotally interlocked one after another to form a shutter curtain. The roller shutter may further include an insulation layer lined across at least two adjacent pivotally interlocked slats of the plurality of slats. The roller shutter may further include at least one retaining mechanism disposed on the insulation layer to press a portion of the insulation layer into a first receiving portion of one of the at least two adjacent pivotally interlocked slats and to press a further portion of the insulation layer into a second receiving portion of the one of the at least two adjacent pivotally interlocked slats such that the at least one retaining mechanism may cooperate with the first and second receiving portions of the one of the at least two adjacent pivotally interlocked slats to hold the insulation layer between the at least one retaining mechanism and the at least two adjacent pivotally interlocked slats. According to various embodiments, the first and the second receiving portions of the one of the at least two adjacent pivotally interlocked slats may be a pair of bent portions of the one of the at least two adjacent pivotally interlocked slats. Each of the pair of bent portions may form an acute angle.

According to various embodiments, there is provided a method of manufacturing a slat assembly. The method may include providing a slat having a first receiving portion and a second receiving portion. The first and second receiving portions of the slat may be a pair of bent portions of the slat. Each of the pair of bent portions may form an acute angle. The method may further include lining an insulation layer on the slat. The method may further include disposing a retaining mechanism on the insulation layer to press a first portion of the insulation layer into the first receiving portion of the slat and to press a second portion of the insulation layer into the second receiving portion of the slat such that the retaining mechanism may cooperate with the first and second receiving portions of the slat to hold the insulation layer between the retaining mechanism and the slat.

According to various embodiments, there is provided a method of manufacturing a roller shutter. The method may include providing a plurality of slats pivotally interlocked one after another to form a shutter curtain. The method may further include lining an insulation layer across at least two adjacent pivotally interlocked slats of the plurality of slats. The method may further include disposing at least one retaining mechanism on the insulation layer to press a portion of the insulation layer into a first receiving portion of one of the at least two adjacent pivotally interlocked slats and to press a further portion of the insulation layer into a second receiving portion of the one of the at least two adjacent pivotally interlocked slats such that the at least one retaining mechanism may cooperate with the first and second receiving portions of the one of the at least two adjacent pivotally interlocked slats to hold the insulation layer between the at least one retaining mechanism and the at least two adjacent pivotally interlocked slats. According to various embodiments, the first and second receiving portions of the one of the at least two adjacent pivotally interlocked slats may be a pair of bent portions of the one of the at least two adjacent pivotally interlocked slats. Each of the pair of bent portions may form an acute angle.

BRIEF DESCRIPTION OF THE DRAWINGS

For a more complete understanding of the description provided herein and the advantages thereof, reference is now made to the brief descriptions below, taken in connection with the accompanying drawings and detailed description, wherein like reference numerals represent like parts. In the drawings, figures are not necessarily to scale, emphasis instead generally being placed upon illustrating the principles of the invention. In the following description, various embodiments are described with reference to the following drawings.

FIG. 15A and FIG. 15B show side views of two slats pivotably interlocked to each other in a suspended mode and in a stacked mode respectively according to various embodiments;

FIG. 15C and FIG. 15D shows perspective views of the two slats in the suspended mode and in the stacked mode respectively according to various embodiments;

DETAILED DESCRIPTION

Embodiments described below in context of the apparatus are analogously valid for the respective methods, and vice versa. Furthermore, it will be understood that the embodiments described below may be combined, for example, a part of one embodiment may be combined with a part of another embodiment.

It should be understood that the terms "on", "over", "top", "bottom", "down", "side", "back", "left", "right", "front", "lateral", "side", "up", "down" etc., when used in the following description are used for convenience and to aid understanding of relative positions or directions, and not intended to limit the orientation of any device, or structure or any part of any device or structure. In addition, the singular terms "a", "an", and "the" include plural references unless context clearly indicates otherwise. Similarly, the word "or" is intended to include "and" unless the context clearly indicates otherwise.

Various embodiments of a slat assembly for a roller shutter, a roller shutter, a method of manufacturing a slat assembly for a roller shutter and a method of manufacturing a roller shutter have been provided to address at least some of the issues identified earlier.

According to various embodiments, an insulation layer in the form of an insulation blanket or an insulation mat or an insulation sheet may be secured or attached or fastened to a slat of a shutter curtain of a roller shutter without puncturing or penetrating the insulation layer with fasteners. Accordingly, the insulation layer may be secured or attached or fastened to the shutter curtain of the roller shutter such that the slats of the shutter curtain may be free of any fasteners that may form a "thermal bridge" through the insulation layer. Hence, the insulation layer may be intact and the thermal insulation integrity of the insulation layer may be fully preserved such that the insulation layer may be effective in providing insulation to the shutter curtain. At the same time, the insulation layer may be properly secured, attached or fastened to the shutter curtain such that the insulation layer may be rolled or unrolled together with the shutter curtain in a manner which minimizes or eliminates misalignment or bulging or tearing or over-stretching of the insulation layer.

Figure 1A:
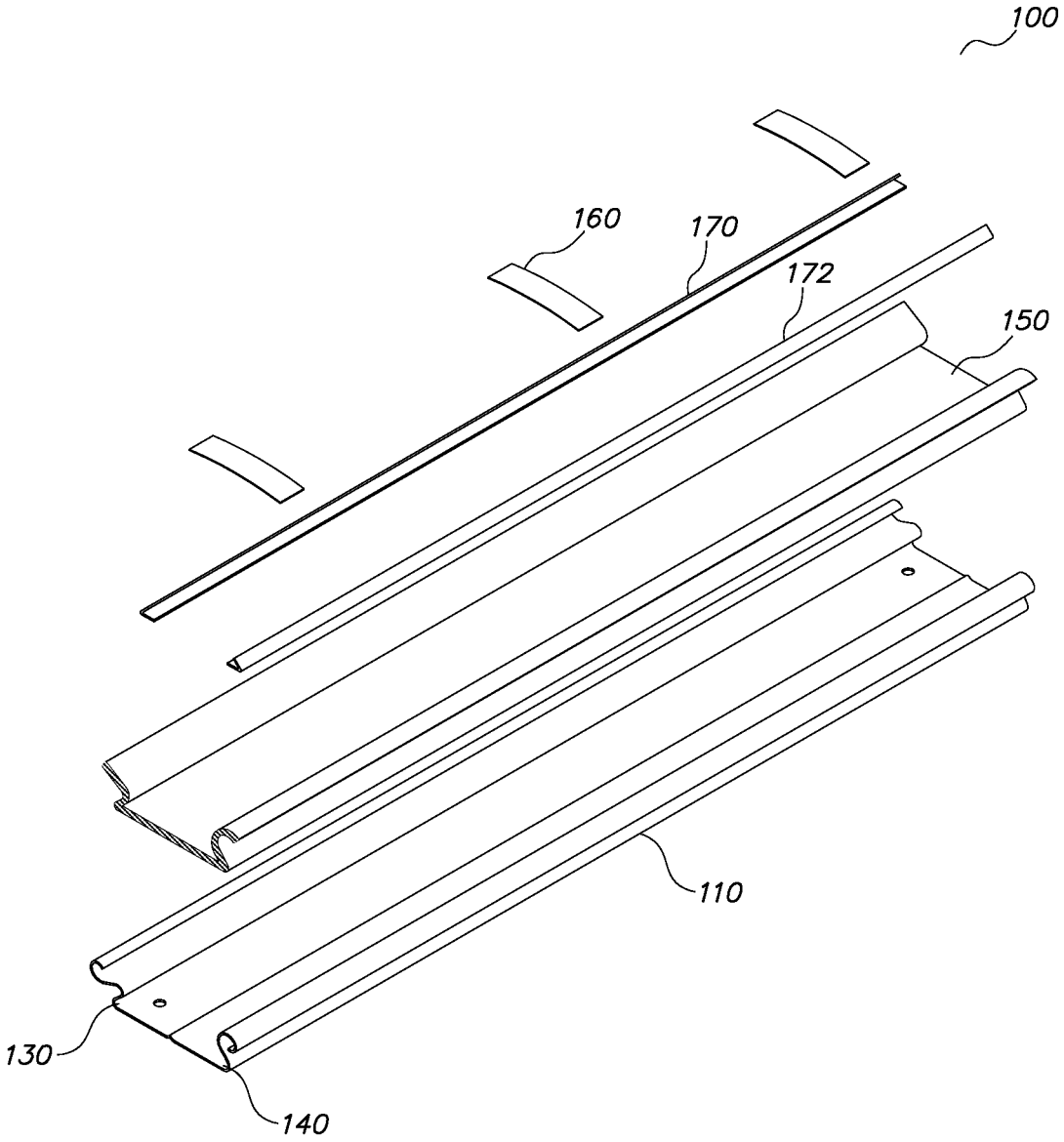
FIG. 1A shows an exploded view of a slat assembly for a roller shutter according to various embodiments.
Figure 1B:
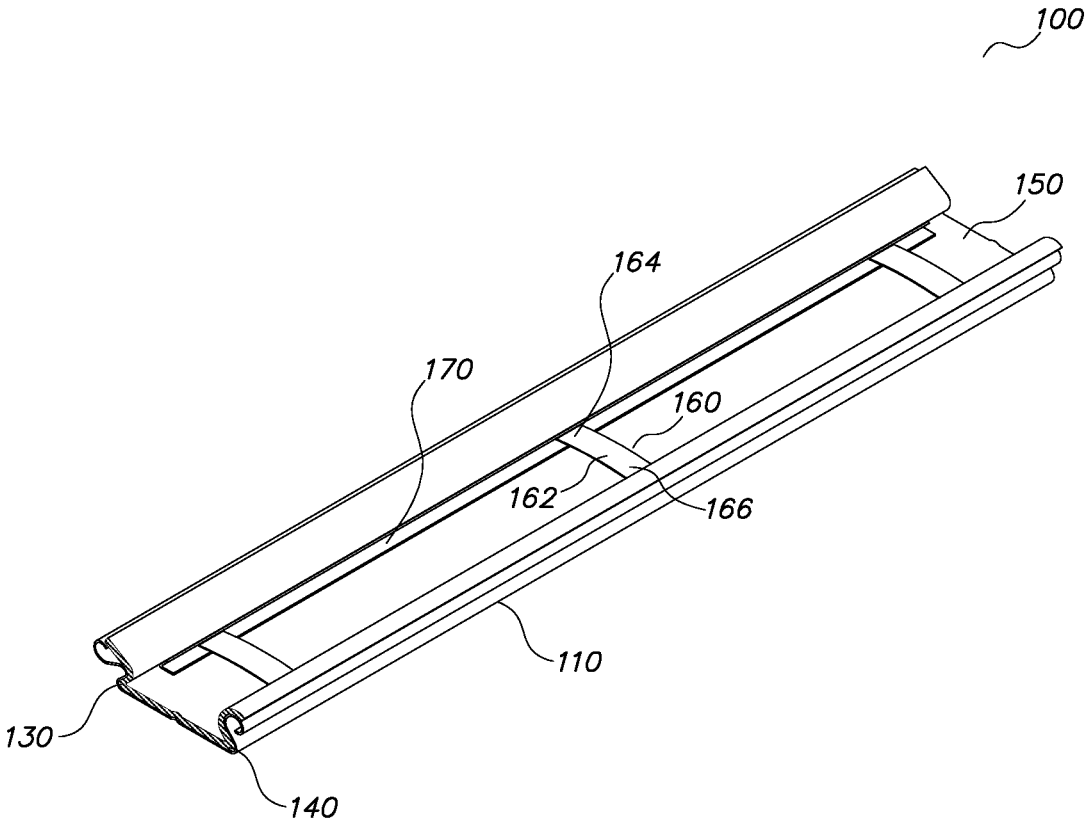
FIG. 1B shows an assembled view of the slat assembly of FIG. 1A according to various embodiments.

FIG. 1A shows an exploded view of a slat assembly 100 for a roller shutter according to various embodiments. FIG. 1B shows an assembled view of the slat assembly 100 of FIG. 1A according to various embodiments. According to various embodiments, the slat assembly 100 may include a slat 110 having a first receiving portion 130 and a second receiving portion 140.

According to various embodiments, the slat 110 may be a narrow flat strip of material, for example metal such as steel or aluminum. According to various embodiments, the first receiving portion 130 and the second receiving portion 140 of the slat 110 may include, for example, recess portions, indentations, slots, grooves, depressions, folded portions, bent portions, channels, cuts, furrows, trench, gutter or any suitable feature which provides a cavity, gap, hollow, void, or empty space configured for receiving, containing, accommodating, holding, or retaining an external insulation element or part or component, such as an insulation layer.

Figure 1C:
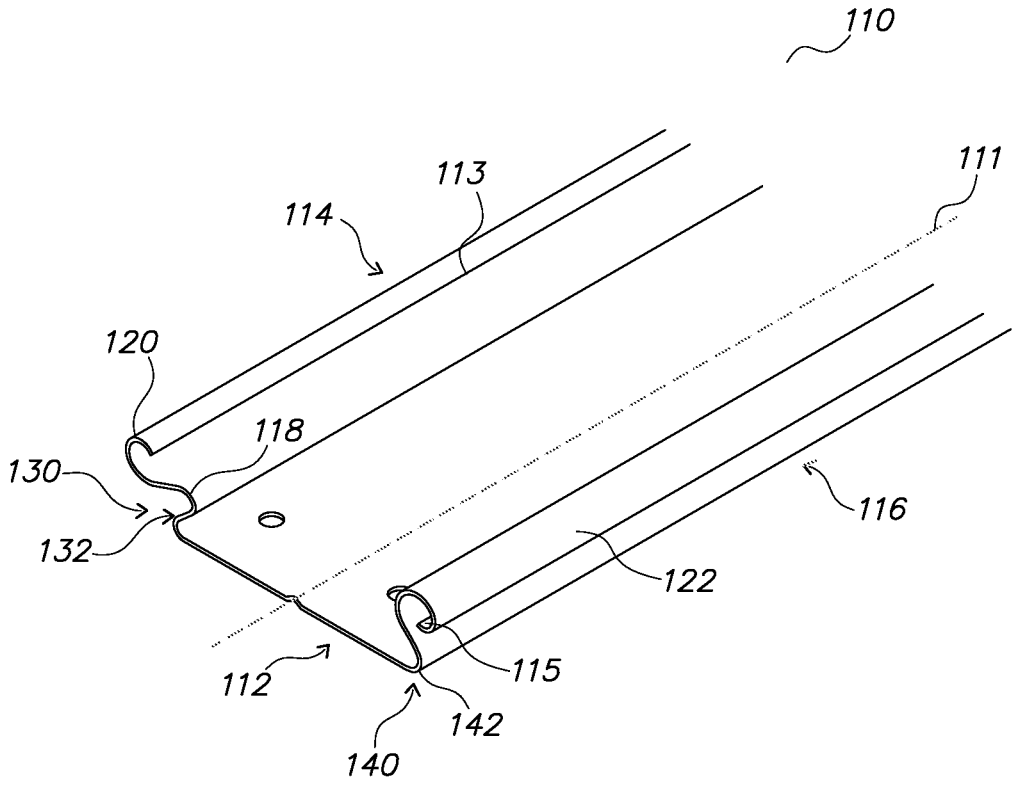
FIG. 1C shows a perspective view of a portion of the slat of the slat assembly of FIG. 1A according to various embodiments.
Figure 1D:
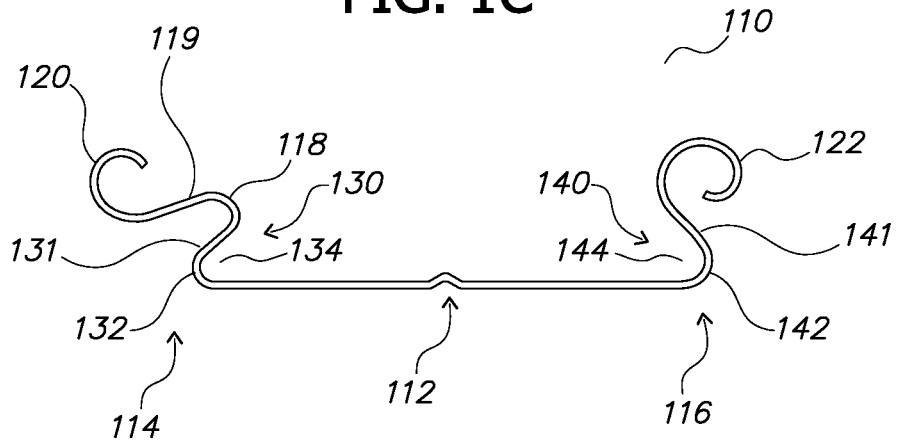
FIG. 1D shows a side view of the slat of FIG. 1C according to various embodiments.

FIG. 1C shows a perspective view of a portion of the slat 110 according to various embodiments. FIG. 1D shows a side view of the slat 110 according to various embodiments. The slat 110 may include a main portion 112 between a first longitudinal edge portion 114 and a second longitudinal edge portion 116. The main portion 112 of the slat 110 may be the main body of the slat 110 for lining abreast or placing side by side with the main portion of adjacent slat so as to form a shutter curtain.

As shown, the first receiving portion 130 of the slat 110 may be an inward bend 132 (or inward fold) at the first longitudinal edge portion 114 of the slat 110. According to various embodiments, the slat 110 may be formed or shaped or profiled or made or molded or pressed from an elongated sheet of material, such as an elongated sheet of metal. Accordingly, the inward bend 132 at the first longitudinal edge portion 114 may be formed from bending or folding a first longitudinal edge 113 of the sheet of material lengthwise inwardly towards a longitudinal axis 111 of the slat 110. Hence, the inward bend 132 may be immediately adjacent to the main portion 112 of the slat 110. As shown, a first elongate overhang portion 131 of the slat 110 may extend laterally from the inward bend 132 of the first longitudinal edge portion 114 such that the first elongate overhang portion 131 of the slat 110 may be angled less than 90° with respect to the main portion 112 of the slat 110. Accordingly, the first elongate overhang portion 131 of the slat 110 and the main portion 112 of the slat 110 may form a groove with a V-shaped or U-shaped or a horse-shoe-shaped cross-section, and the inward bend 132 of the first longitudinal edge portion 114 may of an acute angle. As shown, the second receiving portion 140 of the slat 110 may be an inward bend 142 (or inward fold) at a second longitudinal edge portion 116 of the slat 110. According to various embodiments, the inward bend 142 at the second longitudinal edge portion 116 may be formed from bending or folding a second longitudinal edge 115 of the sheet of material lengthwise inwardly towards the longitudinal axis 111 of the slat 110. Accordingly, the inward bend 142 may be immediately adjacent to the main portion 112 of the slat 110. As shown, a second elongate overhang portion 141 of the slat 110 may extend laterally from the inward bend 142 of the second longitudinal edge portion 116 such that the second elongate overhang portion 141 of the slat 110 may be angled less than 90° with respect to the main portion 112 of the slat 110. Accordingly, the second elongate overhang portion 141 of the slat 110 and the main portion 112 of the slat 110 may form a groove with a V-shaped or U-shaped or horse-shoe-shaped cross-section, and the inward bend 142 of the second longitudinal edge portion 116 may of an acute angle. As shown, the pair of inward bends 132, 142 at the respective first longitudinal edge portion 114 and the second longitudinal edge portion 116 may extend through the entire length of the slat 110 and may be at least substantially parallel to each other. According to various other embodiments, the inward bend at the first longitudinal edge portion and the inward bend at the second longitudinal edge portion may extend along only a portion of the length of the slat. According to various other embodiments, the pair of inward bends may also be non-parallel to each other.

According to various embodiments, the inward bend 132 at the first longitudinal edge portion 114 and the inward bend 142 at the second longitudinal edge portion 116 may form a pair of grooves 134, 144, which may be opposing each other and which may have a V-shaped or U-shaped or a horse-shoe-shaped cross-section. Accordingly, the pair of grooves 134, 144 may be a pair of inwardly bent portions (or folded portions) of the slat 110. Each of the pair of inwardly bent portions of the slat 110 may be formed from bending inwardly towards the longitudinal axis of the slat so as to form the respective acute angle.

As shown in FIG. 1C and FIG. 1D, the inward bend 132 at the first longitudinal edge portion 114 may be followed by an outward bend 118 (or outward fold) formed from subsequent bending or folding of the first longitudinal edge 113 of the elongated sheet of material lengthwise away from the longitudinal axis 111 of the slat 110. Accordingly, from the first elongate overhang portion 131, the sheet of material may be bent or folded outwardly away from the longitudinal axis 111 of the slat 110 to form the outward bend 118. As shown, an elongate winged-like portion 119 of the slat 110 may extend laterally from the outward bend 118 such that the elongate winged-like portion 119 of the slat 110 may be angled less than 90° with respect to the first elongate overhang portion 131 of the slat 110. Accordingly, the elongate winged-like portion 119 of the slat 110 and the first elongate overhang portion 131 of the slat 110 may form a V-shaped or U-shaped cross-section, and the outward bend 118 of the first longitudinal edge portion 114 may of an acute angle. Further, the outward bend 118 of the first longitudinal edge portion 114 may be followed by an inward curl 120 formed from subsequent curling of the first longitudinal edge 113 of the elongated sheet of material lengthwise inwardly towards the longitudinal axis 111 of the slat 110. Accordingly, from the winged-like portion 119 of the slat 110, the sheet of material may be curled inwardly towards the longitudinal axis 111 of the slat 110. Hence, the inward curl 120 may form a first curled edge portion of the slat 110. The first curled edge portion of the slat 110 may be a first interlocking element of the slat 110. Accordingly, the first curled edge portion of the slat 110 may be configured for engaging, interlocking, or interacting with a corresponding interlocking element of another slat to pivotably join the two slats together. According to various embodiments, the first longitudinal edge portion 114 of the slat 110 may include the inward bend 132, the first elongate overhang portion 131, the outward bend 118, the elongate winged-like portion 119, and the inward curl 120.

Further, as also shown, the inward bend 142 at the second longitudinal edge portion 116 may be followed by an outward curl 122 formed from subsequent curling of the second longitudinal edge 115 of the elongated sheet of material lengthwise outwardly away from the longitudinal axis 111 of the slat 110. Accordingly, from the second elongate overhang portion 141, the sheet of material may be curled outwardly away from the longitudinal axis 111 of the slat 110 to form the outward curl 122. Hence, the outward curl 122 may form a second curled edge portion of the slat 110. The second curled edge portion of the slat 110 may be a second interlocking element of the slat 110. Similar to the first curled edge portion, the second curled edge portion of the slat 110 may be configured for engaging, interlocking, or interacting with a corresponding interlocking element of another slat to pivotably join the two slats together. According to various embodiments, the second longitudinal edge portion 116 of the slat 110 may include the inward bend 142, the second elongate overhang portion 141, and the outward curl 122.

According to various embodiments, a curl radius of the inward curl 120 at the first longitudinal edge portion 114 may be smaller than a curl radius of the outward curl 122 at the second longitudinal edge portion 116. Accordingly, two adjacent slats may be joined together by, for example, overlapping, fitting, interlocking, engaging, interacting or joining of an inward curl at a first longitudinal edge portion of a first slat to an outward curl at a second longitudinal edge portion of a second slat such that the first slat may be pivotably joined to the second slat. According to various embodiments, the slat 110 may be configured to overlap or fit or interlock or joined with a further slat 110, one after another in a series, so as to form a shutter curtain.

Referring back to FIG. 1A and FIG. 1B, the slat assembly 100 may further include an insulation layer 150 lined on the slat 110. According to various embodiments, the insulation layer 150 may be in the form of an insulation blanket, an insulation mat, or an insulation sheet. According to various embodiments, the insulation layer 150 may be configured to provide thermal insulation. According to various embodiments, the insulation layer 150 may include a layer of insulation wool sandwiched between two layers of insulation cloths. According to various embodiments, the insulation wool may include ceramic fiber wool or rock wool etc. According to various embodiments, the insulation cloth may include silica fabric or fibre-glass fabric etc.

According to various embodiments, the insulation layer 150 may cover or lay or spread or stretch across a side of the slat 110 whereby the first receiving portion 130 and the second receiving portion 140 may be accessible. Accordingly, the side of the slat 110 on which the insulation layer 150 is lined may be opposite to the exterior side or surface of the slat 110 exposed to the exterior of the premises which the shutter may be installed.

As shown in FIG. 1A and FIG. 1B, the slat assembly 100 may further include a retaining mechanism 160 (or at least one retaining mechanism) disposed on the insulation layer 150 to urge or press or push a first portion of the insulation layer 150 against the first receiving portion 130 of the slat 110 and to urge or press or push a second portion of the insulation layer 150 against the second receiving portion 140 of the slat 110 such that the retaining mechanism 160 may cooperate with the first receiving portion 130 and the second receiving portion 140 of the slat 110 to hold or clamp or grip or clench the insulation layer 150 between the retaining mechanism 160 and the slat 110 without puncturing or penetrating the insulation layer 150. Accordingly, the insulation layer 150 may be sandwiched between the retaining mechanism 160 and the slat 110. According to various embodiments, a first surface of the insulation layer 150 may be in contact with the slat while the retaining mechanism 160 may be placed or received or disposed on a second surface of the insulation layer 150. The first surface and the second surface of the insulation layer 150 may be opposite surfaces.

While FIG. 1A and FIG. 1B show that one retaining mechanism 160 may be disposed to simultaneously urge the first portion of the insulation layer 150 against the first receiving portion 130 of the slat 110 and the second portion of the insulation layer 150 against the second receiving portion 140 of the slat 110, it should be understood by those skilled in the art that various changes, modification, variation may be made.

According to various embodiments, the slat assembly 100 may include one or two or more or a plurality of retaining mechanisms 160. Referring back to FIG. 1A and FIG. 1B, according to various embodiments, the retaining mechanism 160 may include a first end 164 and a second end 166. According to various embodiments, the first end 164 and the second end 166 may be opposite ends of the retaining mechanism 160. The first end 164 may be configured for urging or pressing or pushing the first portion of the insulation layer 150 against the first receiving portion 130 of the slat 110. Accordingly, the first portion of the insulation layer 150 may be sandwiched between the first end 164 of the retaining mechanism 160 and the first receiving portion 130 of the slat 110. Further, the second end 166 may be configured for urging or pressing or pushing the second portion of the insulation layer 150 against the second receiving portion 140 of the slat 110. Accordingly, the second portion of the insulation layer 150 may be sandwiched between the second end 166 of the retaining mechanism 160 and the second receiving portion 140 of the slat 110. According to various embodiments, the first receiving portion 130 of the slat 110 and the second receiving portion 140 of the slat 110 may be at opposing longitudinal edge portions 114, 116 of the slat 110.

According to various embodiments, the retaining mechanism 160 may be pre-loaded so as to supply an expansion force for urging, pressing, or pushing the first portion and the second portion of the insulation layer 150 against the respective first receiving portion 130 and the second receiving portion 140 of the slat 110. Accordingly, the retaining mechanism 160 may be pre-compressed prior to being disposed on the insulation layer 150, such that when the retaining mechanism 160 is disposed on the insulation layer 150, the retaining mechanism 160 may apply a spreading force or expansion force on the insulation layer 150 such that the retaining mechanism 160 may urge or press or push respective portions of the insulation layer 150 against the respective first receiving portion 130 and the second receiving portion 140 of the slat 110, which may be opposing facing relative to each other. Hence, the retaining mechanism 160 may be pre-loaded such that the first end 164 and the second end 166 of the retaining mechanism 160 may be biased away from each other so as to engage or contact or interact with the respective portions of the insulation layer 150 for urging or pressing or pushing the respective portions of the insulation layer 150 against the respective first receiving portion 130 and second receiving portion 140 of the slat 110.

According to various embodiments, the retaining mechanism 160 may be configured to press the first portion of the insulation layer 150 into the first receiving portion 130 of the slat 110 and to press the second portion of the insulation layer 150 into the second receiving portion 140 of the slat 110. Accordingly, the force exerted by the first end 164 of the retaining mechanism 160 may cause the first portion of the insulation layer 150 to be received, contained, accommodated, held, or retained in the first receiving portion 130 of the slat 110. Similarly, the force exerted by the second end 166 of the retaining mechanism 150 may cause the second portion of the insulation layer 150 to be received, contained, accommodated, held, or retained in the second receiving portion 140 of the slat 110. Hence, the first end 164 and the second end 166 of the retaining mechanism 160 may cooperate with the first receiving portion 130 and the second receiving portion 140 of the slat 110 to hold or clamp or grip or clench the insulation layer 150 therebetween without puncturing or penetrating the insulation layer 150.

Referring back to FIG. 1A and FIG. 1B, the retaining mechanism 160 may include an insert 162 in the form of a strip of resilient material. The resilient material may include high tensile steel or any other suitable materials. According to various embodiments, the insert 162 in the form of the strip of resilient material may have a length longer than a distance, such as a transverse distance or a perpendicular distance, between the first receiving portion 130 and the second receiving portion 140 of the slat 110. Accordingly, the insert 162 may have to be bent elastically prior to disposing the insert 162 on the insulation layer 150 until a direct distance between the two ends 164, 166 of the insert 162 is smaller than the distance between the first receiving portion 130 and the second receiving portion 140 of the slat 110. Subsequently, when the insert 162 is disposed on insulation layer 150, the force applied to bend the insert 162 may be removed such that the insert 162 may reverse the bending and try to return to the unbended state. Accordingly, the tendency of the insert 162 to unbend may cause the respective ends 164, 166 of the insert 162 to urge or press or push the corresponding portions of the insulation layer 150 into the respective first receiving portion 130 and the second receiving portion 140 of the slat 110.

As shown in FIG. 1A and FIG. 1B, the slat assembly 100 may further include a first pusher member 170. The first pusher member 170 may be disposed between the first portion of the insulation layer 150 and the retaining mechanism 160 (for example the first end 164 of the insert 162). The first pusher member 170 may be aligned with the first receiving portion 130 (for example a first groove 134 of the pair of grooves 134, 144 as shown). Accordingly, the retaining mechanism 160 may urge or push or press the first pusher member 170 at a portion of the first pusher member 170 which may then be translated into the first pusher member 170 urging or pushing or pressing the first portion of the insulation layer 150 evenly against or into the entire length of the first receiving portion 130 of the slat 110. According to various embodiments, the first pusher member 170 may include a bar with a V-shaped cross-section or a U-shaped cross-section or a horse-shoe shaped cross-section or any suitable cross-section that may be accommodated in the first receiving portion 130 of the slat 110.

As shown in FIG. 1A and FIG. 1B, the slat assembly 100 may further include a second pusher member 172. Similarly, the second pusher member 172 may be disposed between the second portion of the insulation layer 150 and the retaining mechanism 160 (for example the second end 166 of the insert 162). The second pusher member 172 may be aligned with the second receiving portion 140 (for example a second groove 144 of the pair of grooves 134, 144 as shown).

Accordingly, the retaining mechanism 160 may urge or push or press the second pusher member 172 at a portion of the second pusher member 172 which may then be translated into the second pusher member 172 urging or pushing or pressing the second portion of the insulation layer 150 evenly against or into the entire length of the second receiving portion 140 of the slat 110. According to various embodiments, the second pusher member 172 may include a bar with a V-shaped cross-section or a U-shaped cross-section or a horse-shoe shaped cross-section or any suitable cross-section that may be accommodated in the second receiving portion 140 of the slat 110.

Figure 2A:
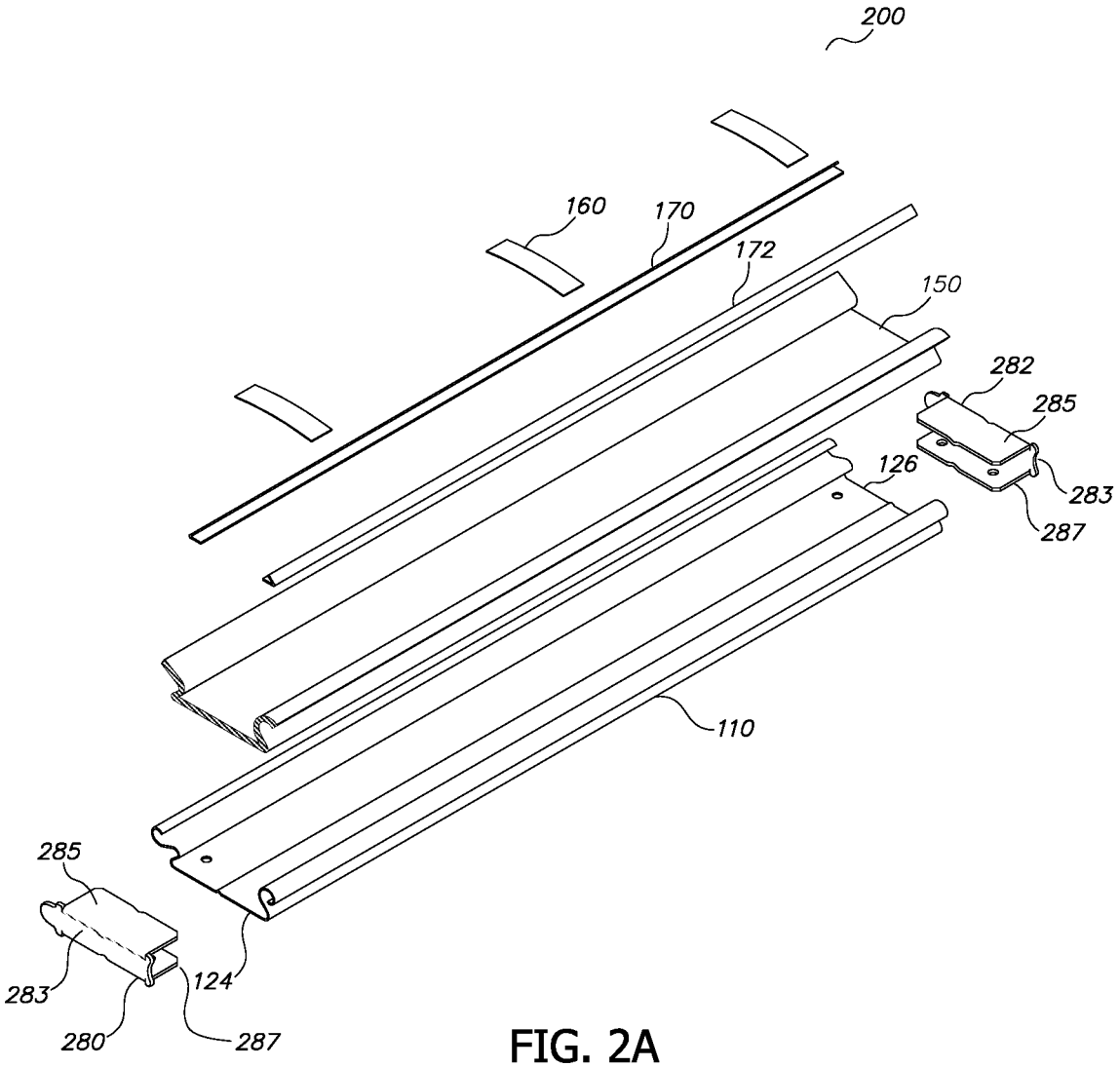
FIG. 2A shows an exploded view of a slat assembly for a roller shutter according to various embodiments.
Figure 2B:
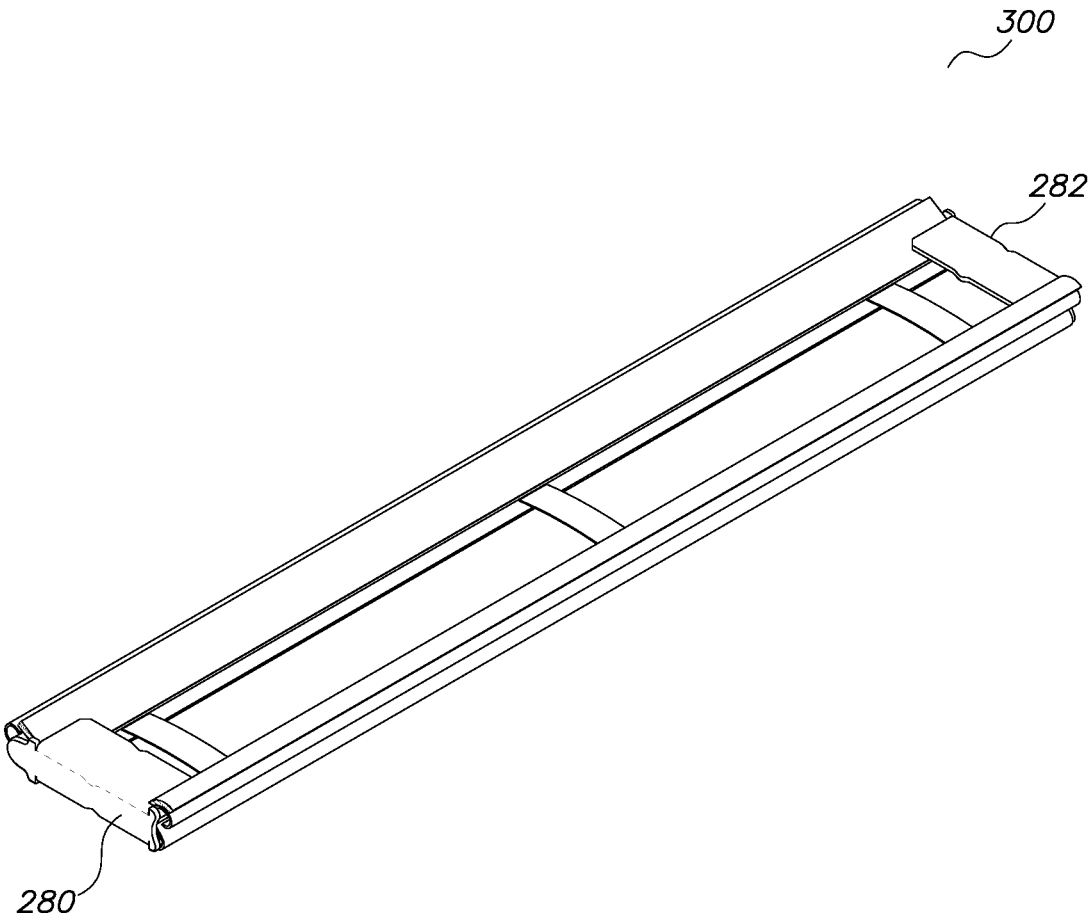
FIG. 2B shows an assembled view of the slat assembly of FIG. 2A according to various embodiments.

FIG. 2A shows an exploded view of a slat assembly 200 for a roller shutter according to various embodiments. FIG. 2B shows an assembled view of the slat assembly 200 of FIG. 2A according to various embodiments. The slat assembly 200 of FIG. 2A and FIG. 2B differs from the slat assembly 100 of FIG. 1A and FIG. 1B in that the slat assembly 200 include two side covers 280, 282 (or end-clips) attached to respective ends 124, 126 of the slat 110. Accordingly, one side cover may be attached to one end of the slat 110. The side covers 280, 282 may be configured to cover or contain or enclose or conceal or wrap around respective edge portion of the insulation layer 150 along the respective ends 124, 126 of the slat 110. Accordingly, the side covers 280, 282 may prevent the insulation layer 150 from sliding out of the slat 110 via either ends 124, 126 of the slat 110. Further, the side cover 280, 282 may be a three-sided rigid pressed-steel component (with substantially U-shaped cross section) enclosing or concealing or covering the edge portions of the insulation layer 150 to protect the respective edge portions of the insulation layer 150 from scuffing or scraping against the guide rails or shutter guide channels while rolling and unrolling of the shutter curtain during shutter operation. Such scuffing or scraping of the insulation layer 150 may cause the respective edge portions of the fabric forming the insulation layer 150 to fray, which may in turn lead to unraveling of the fabric resulting in loose fibre threads etc. These loose fibre threads may be caught or entangled in the roller shutter assembly (for example, protrusions or projections or features that are jutting out) to cause further tearing of the insulation layer 150. Thus, the side covers 280, 282 may minimize or prevent damage and fraying of the insulation layer 150 due to wear and tear by enclosing the respective edge portions of the insulation layer 150 and prevent the respective edge portions of the insulation blanket from coming into contact with the guide rails or shutter guide channels. According to various embodiments, the side-cover 280, 282 in the form of the three-sided rigid pressed-steel component may include a flat rectangular base portion 283 and a pair of wall portions 285, 287 extending perpendicularly from two longitudinal edges of the flat rectangular base portion 283. Accordingly, the respective edge portions of the insulation layer 150 may be slotted or fitted in or inserted between the pair of wall portions 285, 287 and aligned to the base portion 283.

Figure 3A:
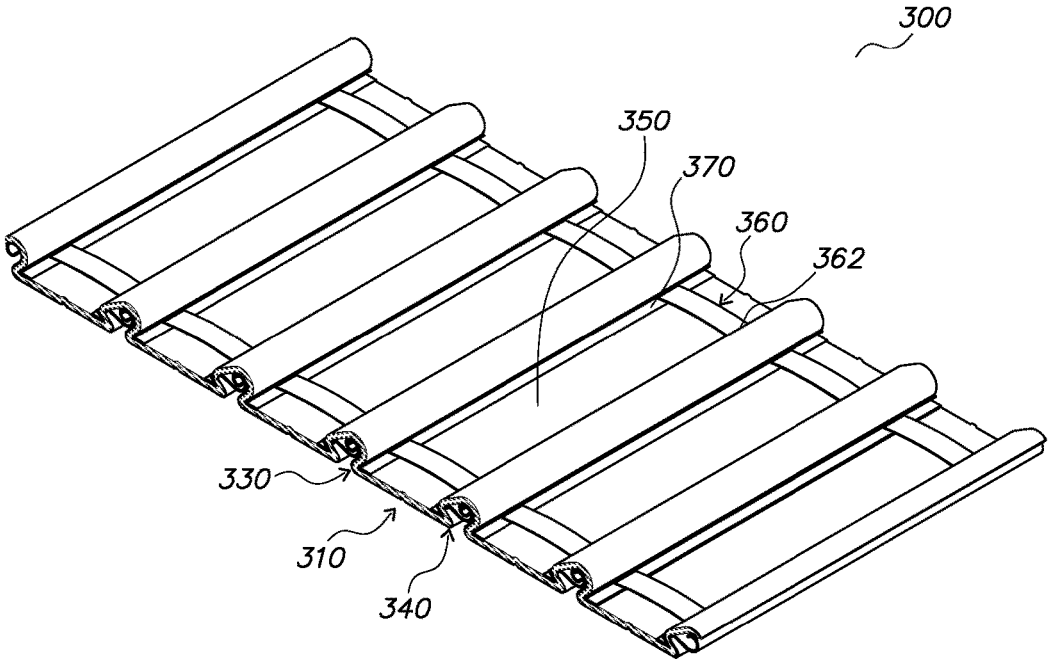
FIG. 3A shows a perspective view of a shutter curtain assembly according to various embodiments.
Figure 3B:
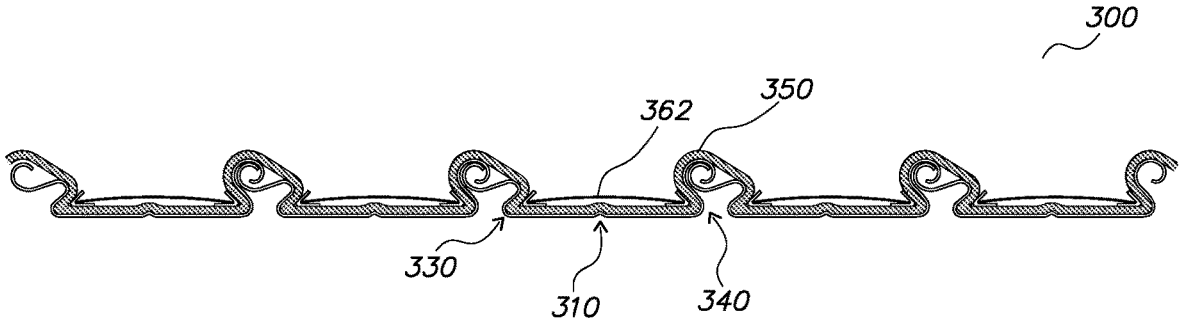
FIG. 3B shows a side view of the shutter curtain assembly of FIG. 3A according to various embodiments.
Figure 3C:
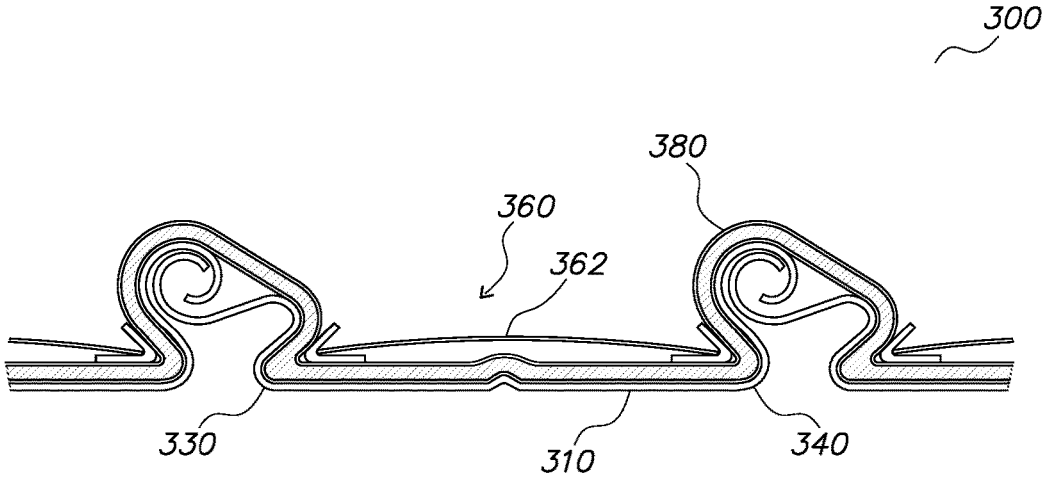
FIG. 3C shows an enlarged side view of a section of the shutter curtain assembly of FIG. 3A according to various embodiments.

FIG. 3A shows a perspective view of a shutter curtain assembly 300 according to various embodiments. FIG. 3B shows a side view of the shutter curtain assembly 300 of FIG. 3A according to various embodiments. FIG. 3C shows an enlarged side view of a section of the shutter curtain assembly 300 of FIG. 3A according to various embodiments. According to various embodiments, shutter curtain assembly 300 may be a component of a roller shutter. As shown, the shutter curtain assembly 300 may include a plurality of slats 310 pivotally interlocked one after another in a series to form a shutter curtain. According to various embodiments, one slat may be joined to another slat along its length. Accordingly, multiple slats may be joined in sequence, one after another in a series, to form the shutter curtain.

As shown, the shutter curtain assembly 300 may further include an insulation layer 350 lined across at least two adjacent pivotally interlocked slats of the plurality of slats 310. According to various embodiments, the insulation layer 350 may be sized to line across a desired number of slats 310. According to various embodiments, the insulation layer 350 may also be sized to line across the entire shutter curtain made up of the plurality of slats 310. According to various embodiments, the insulation layer 350 may be formed by stitching or joining multiple pieces. According to various embodiments the insulation layer 350 may be weaved as a single piece.

According to various embodiments, the shutter curtain assembly 300 may further include at least one retaining mechanism 360 disposed on the insulation layer 350 to urge or press or push a portion of the insulation layer 350 against a first receiving portion 330 of one of the at least two adjacent pivotally interlocked slats 310 and to urge or press or push a further portion of the insulation layer 350 against a second receiving portion of the one of the at least two adjacent pivotally interlocked slats 310 such that the at least one retaining mechanism 360 may cooperate with the first receiving portion 330 and the second receiving portion 340 of the one of the at least two adjacent pivotally interlocked slats 310 to hold or clamp or grip or clench the insulation layer 350 between the retaining mechanism 360 and the at least two adjacent pivotally interlocked slats 350 without puncturing or penetrating the insulation layer 350. The retaining mechanism 360 may, similar to the retaining mechanism 160 of FIG. 1A and FIG. 1B, include a first end configured for urging or pressing or pushing the first portion of the insulation layer 350 against the first receiving portion 330 of the slat 310. The retaining mechanism 360 may, similar to the retaining mechanism 160 of FIG. 1A and FIG. 1B, also include a second end configured for urging or pressing or pushing the second portion of the insulation layer 350 against the second receiving portion 340 of the slat 310.

As shown in FIG. 3A and FIG. 3B, the shutter curtain assembly 300 may include one or two or more or a plurality of retaining mechanisms 360. Further, each slat 310 of the plurality of slats 310 may also include respective first receiving portion 330 and second receiving portion 340. Accordingly, the insulation layer 350 may be lined across the plurality of slats 310 and corresponding portions of the insulation layer 350 may be hold or clamp or grip or clench between the respective retaining mechanism 360 and the respective slat 310.

Similar to the slat assembly 100 of FIG. 1A and FIG. 1B, the first receiving portion 330 and the second receiving portion 340 of the slat 310 may be a pair of parallel opposing grooves which may be a pair of bent portions of the slat 310. Further, the at least one retaining mechanism 360 may be pre-loaded to supply an expansion force for biasing the first end and the second end of the retaining mechanism 360 away from each other so as to urge or press or push the respective portions of the insulation layer against the respective first receiving portion 330 and second receiving portion 340 of the respective slat 310. The at least one retaining mechanism 360 may also be configured to press respective portions of the insulation layer 350 into the respective first receiving portion 330 and second receiving portion 340 of the respective slat 310. Furthermore, the retaining mechanism 360 may be an insert 362 in the form of a strip of resilient material which has a length longer than a distance between the respective first receiving portion 330 and second receiving portion 340 of the respective slat. In addition, the insulation layer 350 may include a layer of insulation wool sandwiched between two layers of insulation cloths. According to various embodiments, the insulation wool may include ceramic fiber wool or rock wool etc. According to various embodiments, the insulation cloth may include silica fabric or fibre-glass fabric etc.

According to various embodiments, the shutter curtain assembly 300 may further include at least one pusher member 370. The at least one pusher member 370 may be disposed between the insulation layer 350 and the at least one retaining mechanism 360. The at least one pusher member 370 may be aligned with one of the first receiving portion 330 or the second receiving portion 340 (for example a groove of the pair of parallel opposing grooves) of at least one slat 310. The at least one pusher member 370 may include a bar with a V-shaped cross-section or a U-shaped cross-section or horse-shoe shaped cross-section or any suitable cross-section for accommodating in the respective receiving portions 330, 340 of the slat 310.

As shown in FIG. 3A and FIG. 3B, the shutter curtain assembly 300 may include one or two or more or a plurality of pusher members 370. According to various embodiments, there may be two pusher members 370 aligned to the two receiving portions 330, 340 of each slat 310. Accordingly, respective retaining mechanism 360 may urge or press or push the respective two pusher members 370 such that corresponding portions of the insulation layer 350 may be urged or pressed or pushed into the respective receiving portions 330, 340 of each slat 310 so as to be held or clamp or grip or clench between the respective pusher member 370 and the respective receiving portion 330, 340 of the slat 310.

Figure 4:
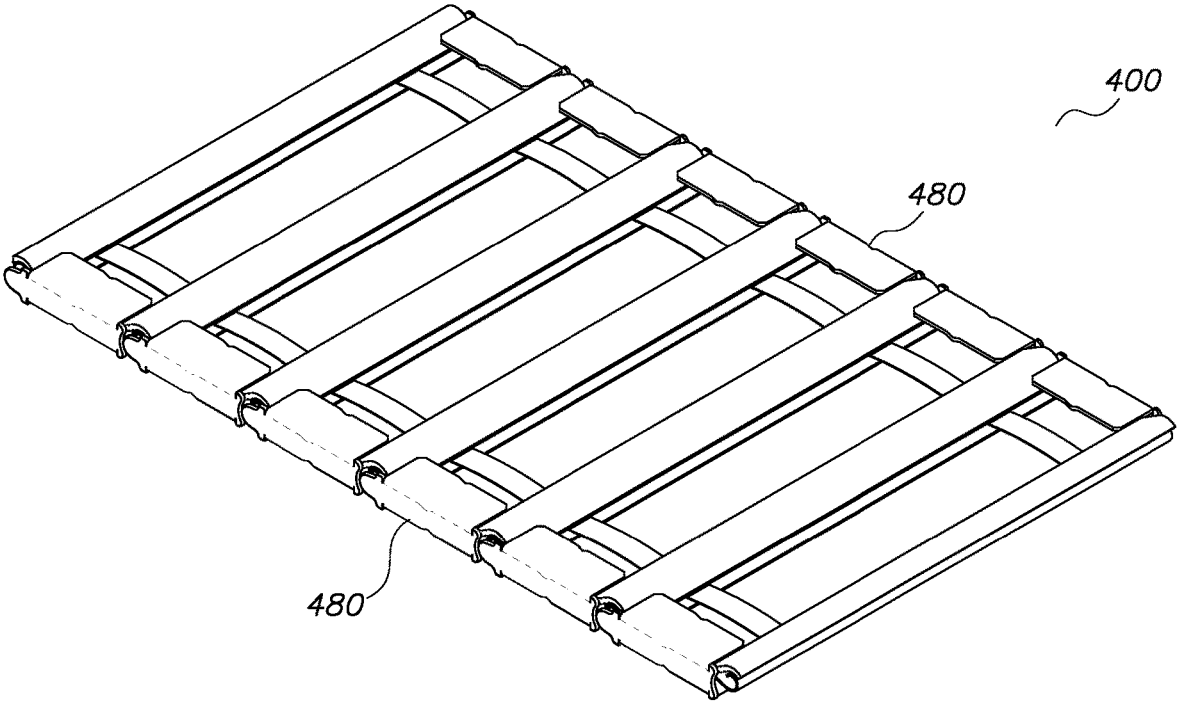
FIG. 4 shows a perspective view of a shutter curtain assembly according to various embodiments.

FIG. 4 shows a perspective view of a shutter curtain assembly 400 according to various embodiments. The shutter curtain assembly 400 of FIG. 4 differs from the shutter curtain assembly 300 of FIG. 3A and FIG. 3B in that the shutter curtain assembly 400 may include at least two side covers 480 attached to respective ends of at least one slat 310. As shown in FIG. 4, the shutter curtain assembly 400 may include a plurality of side covers such that one side cover 480 is attached to one end of each slat 310.

Figure 5A:
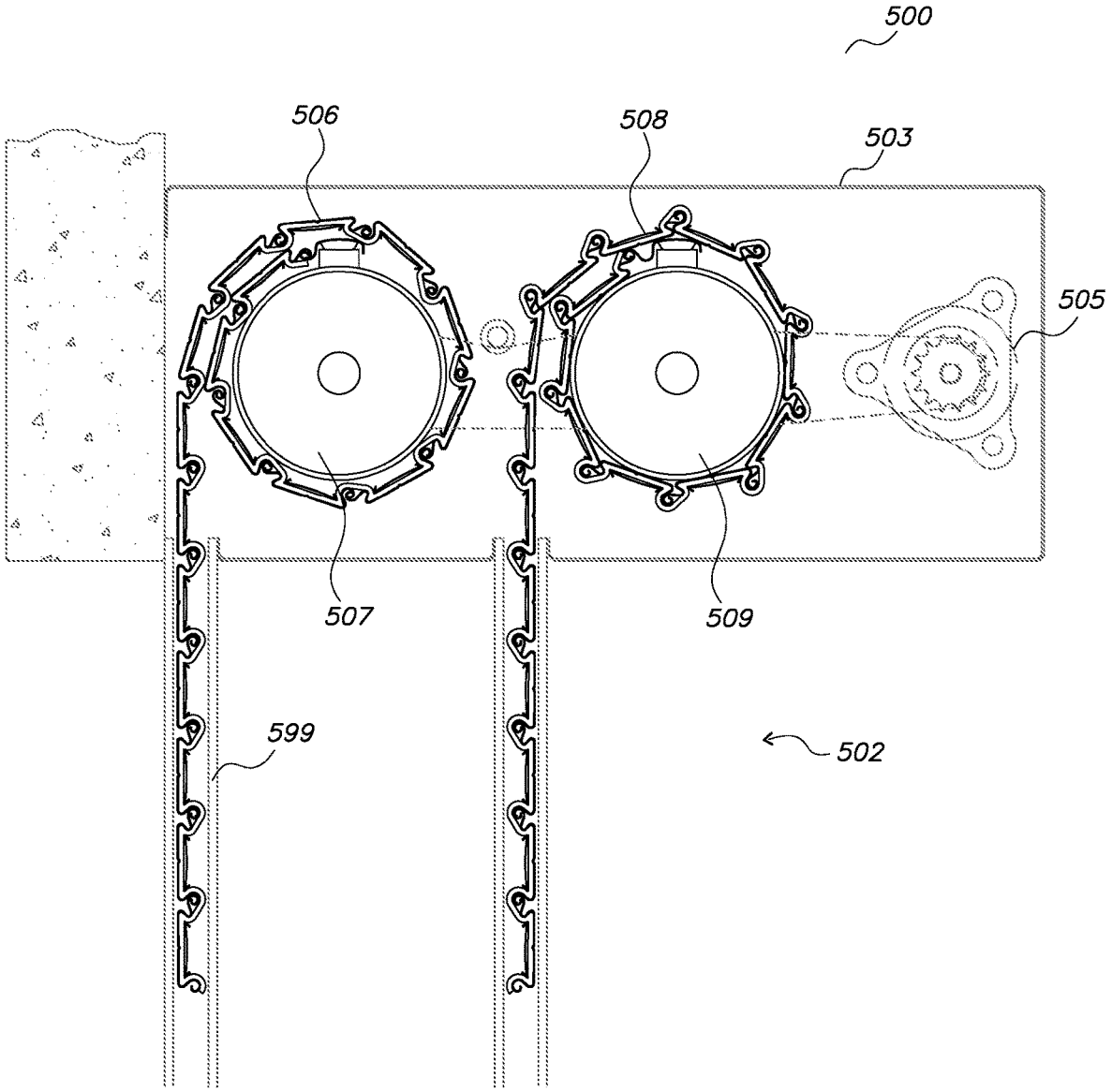
FIG. 5A shows a side cross-sectional view of an upper portion of a vertical roller shutter according to various embodiments.
Figure 5B:
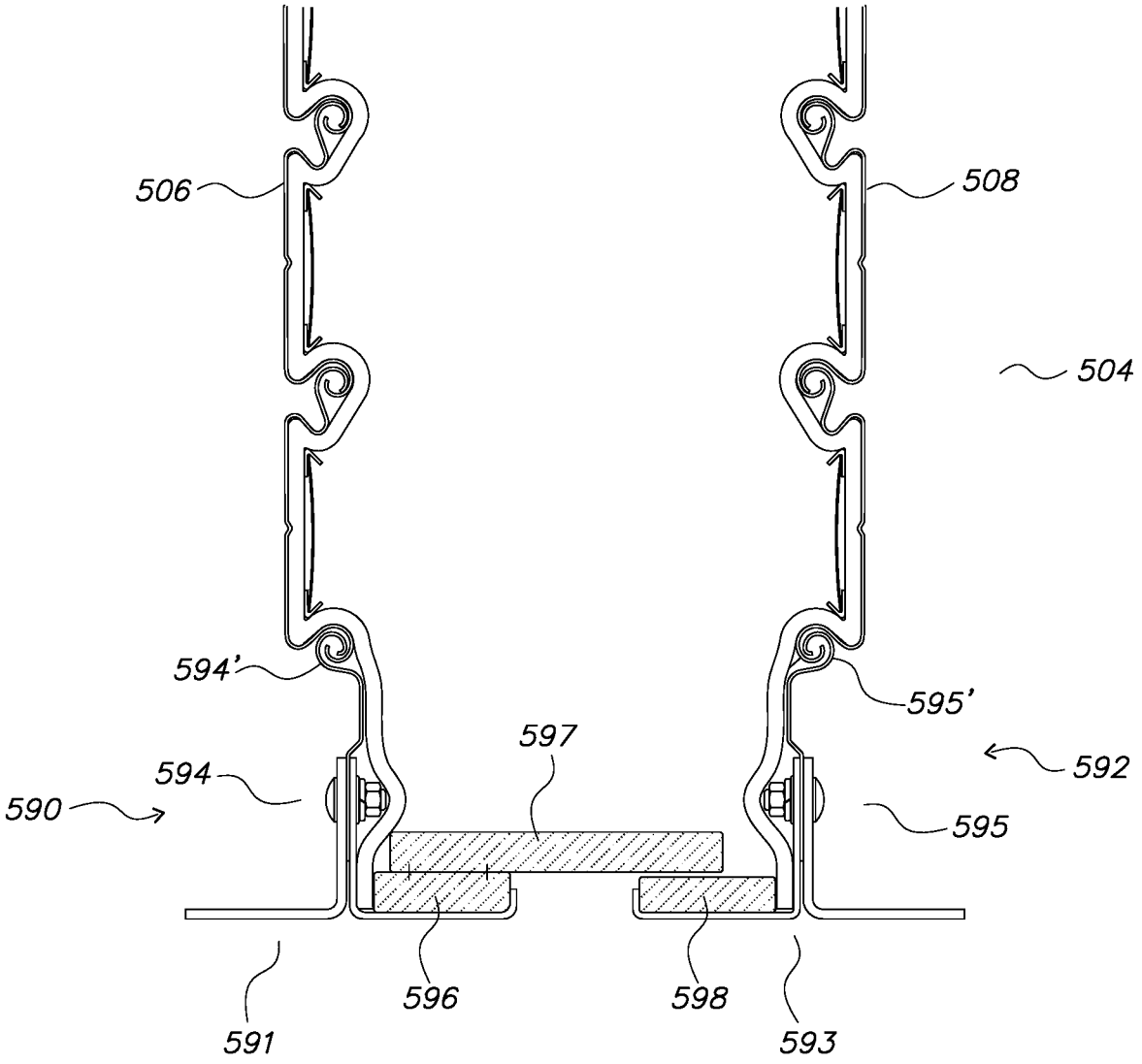
FIG. 5B shows a side cross-sectional view of a lower portion of the vertical roller shutter, when in a lowered state, according to various embodiments.

FIG. 5A shows a side cross-sectional view of an upper portion 502 of a vertical roller shutter 500 according to various embodiments. FIG. 5B shows a side cross-sectional view of a lower portion 504 of the vertical roller shutter 500, when in a lowered state, according to various embodiments. As shown, the vertical roller shutter 500 may include a pair of shutter curtain assemblies 506, 508. The vertical roller shutter 500 may be configured such that the pair of shutter curtain assemblies 506, 508 may be raised up and lowered down vertically. Accordingly, when in the lowered state, the pair of shutter curtain assemblies 506, 508 may be spaced apart and parallel to each other such that the pair of shutter curtain assemblies 506, 508 may be facing each other. According to various embodiments, each of the pair of shutter curtain assemblies 506, 508 may be the shutter curtain assembly 300 of FIG. 3A & FIG. 3B, and/or the shutter curtain assembly 400 of FIG. 4. According to various embodiments, the respective insulating layers of the respective shutter curtain assemblies 506, 508 may be lined on respective surfaces of the respective shutter curtain assemblies 506, 508 such that they are facing each other. According to various embodiments, a first shutter curtain assembly 506 of the pair of shutter curtain assemblies may be coupled to a first drum 507 with the plurality of slats of the first shutter curtain assembly 506 arranged at least substantially parallel to a longitudinal axis of the first drum 507 such that the first shutter curtain assembly 506 may be rolled on and off the first drum 507. Similarly, a second shutter curtain assembly 508 of the pair of shutter curtain assemblies may be coupled to a second drum 509 with the plurality of slats of the second shutter curtain assembly 508 arranged at least substantially parallel to a longitudinal axis of the second drum 509 such that the second shutter curtain assembly 508 may be rolled on and off the second drum 509.

The roller shutter 500 may further include a housing 503 configured to be mounted to a wall or a beam or an overhanging structure. The housing 503 may be configured to enclose the pair of drums 507, 509 and a motor assembly 505. The motor assembly 505 and the pair of drums 507, 509 may be arranged such that the motor assembly 505 may drive the rotation of the pair of drums 507, 509 synchronously. For example, as shown, the pair of drums 507, 509 and the motor assembly 505 may be arranged in a lateral arrangement (or horizontally) with their rotational axes lying on a horizontal plane. In this arrangement, a belt or a chain mechanism may couple the pair of drums 507, 509 to the motor assembly 505 such that the motor assembly 505 may simultaneous drive the rotation of both the drums 507, 509 in a coordinated manner to roll in or roll out both the shutter curtain assemblies 506, 508 at the same time in a synchronized manner. Accordingly, the motor assembly 505 may drive both the drums 507, 509 to rotate in a same first direction (for example, clockwise direction from the view as shown in FIG. 5A) for rolling in both the shutter curtain assemblies 506, 508, and drive both the drums 507, 509 to rotate in a same second direction (for example, anti-clockwise direction from the view as shown in FIG. 5A) for rolling out both the shutter curtain assemblies 506, 508.

Further, according to various embodiments, guide rails 599 (or shutter guide channels) may be provided along the sides of the wall, which the roller shutter 500 may be mounted to, such that the side edges of the pair of shutter curtain assemblies 506, 508 may be inserted or slotted or placed into the guide rails 599 (or shutter guide channels) so as to be raised up or lowered down in a guided manner.

In FIG. 5B, the lower portion 504 of the pair of shutter curtain assemblies 506, 508 is shown. The first shutter curtain assembly 506 may have a foot component 590 connected to the last slat of the first shutter curtain assembly 506. The second shutter curtain assembly 508 may also have a foot component 592 connected to the last slat of the second shutter curtain assembly 508. The respective foot components 590, 592 of the respective shutter curtain assemblies 506, 508 may have a substantively 'inverted-T' shape cross-section. Accordingly, each foot component 590, 592 may have a lateral base portion 591, 593 and a connecting portion 594, 595 extending perpendicularly from a middle or centerline or longitudinal axis of the respective lateral base portion 591, 593. As shown, a longitudinal edge portion of the respective connecting portions 594, 595 of the respective foot components 590, 592 may be curled inwardly towards the respective lateral base portion 591, 593 to form respective curled edge portions 594', 595' so as to engage with the outward curled edge portion of the last slat of the respective shutter curtain assemblies 506, 508.

As shown in FIG. 5B, according to an example implementation, the foot component 590, 592 may include two elongated L-shaped bars, wherein the vertical portions of the respective elongated L-shaped bars are arranged back-to-back. Further, the foot component 590, 592 may include a half-slat element with an inwardly curled portion along one of the longitudinal edge and a flat portion along the other longitudinal edge. Accordingly, the flat portion of the half-slat element may be sandwiched between the vertical portions of the respective elongated L-shaped bars and joined together to form the respective foot components 590, 592. The joining may be via bolt and nut or any other suitable fasteners.

According to various embodiments, the insulating layer of the respective shutter curtains 506, 508 may also extend over and cover the connecting portions 594, 595 of the respective foot components 590, 592. Accordingly, the respective connecting portions 594, 595 of the respective foot components 590, 592 may be lined with the respective insulating layers. According to various embodiments, the foot components 590, 592 of the pair of shutter curtain assemblies 506, 508 may include an insulating seal arrangement to seal a gap between the foot component 590 of the first shutter curtain assembly 506 and the foot component 592 of the second shutter curtain assembly 508.

For example, as shown in FIG. 5B, each of the foot components 590, 592 may further include an insulating block 596, 598 laid on the respective lateral base portions 591, 593. According to various embodiments, the insulating block 596, 598 may be laid on the part of the respective lateral base portions 592, 593 that is extending towards the other shutter curtain assemblies 506, 508. As shown, the insulating block 596 of the foot component 590 of the first shutter curtain assembly 506 may be laid on the part of the lateral base portion 591 extending towards the second shutter curtain assembly 508. Similarly, the insulating block 598 of the foot component 592 of the second shutter curtain assembly 508 may be laid on the part of the lateral base portion 593 extending towards the first shutter curtain assembly 506.

According to various embodiments, an overlapping insulating block 597 may be attached to either the insulating block 596 of the foot component 590 of the first shutter curtain assembly 506 or the insulating block 598 of the foot component 592 of the second shutter curtain assembly 508. In this configuration, the overlapping insulating block 597 may seal off a gap between the foot component 590 of the first shutter curtain assembly 506 and the foot component 592 of the second shutter curtain assembly 508. Accordingly, an enclosed void or space between the first shutter curtain assembly 506 and the second shutter curtain assembly 508 may be insulated to form an insulating air gap which may enhance the fire insulation of the roller shutter 500.

Figure 6:
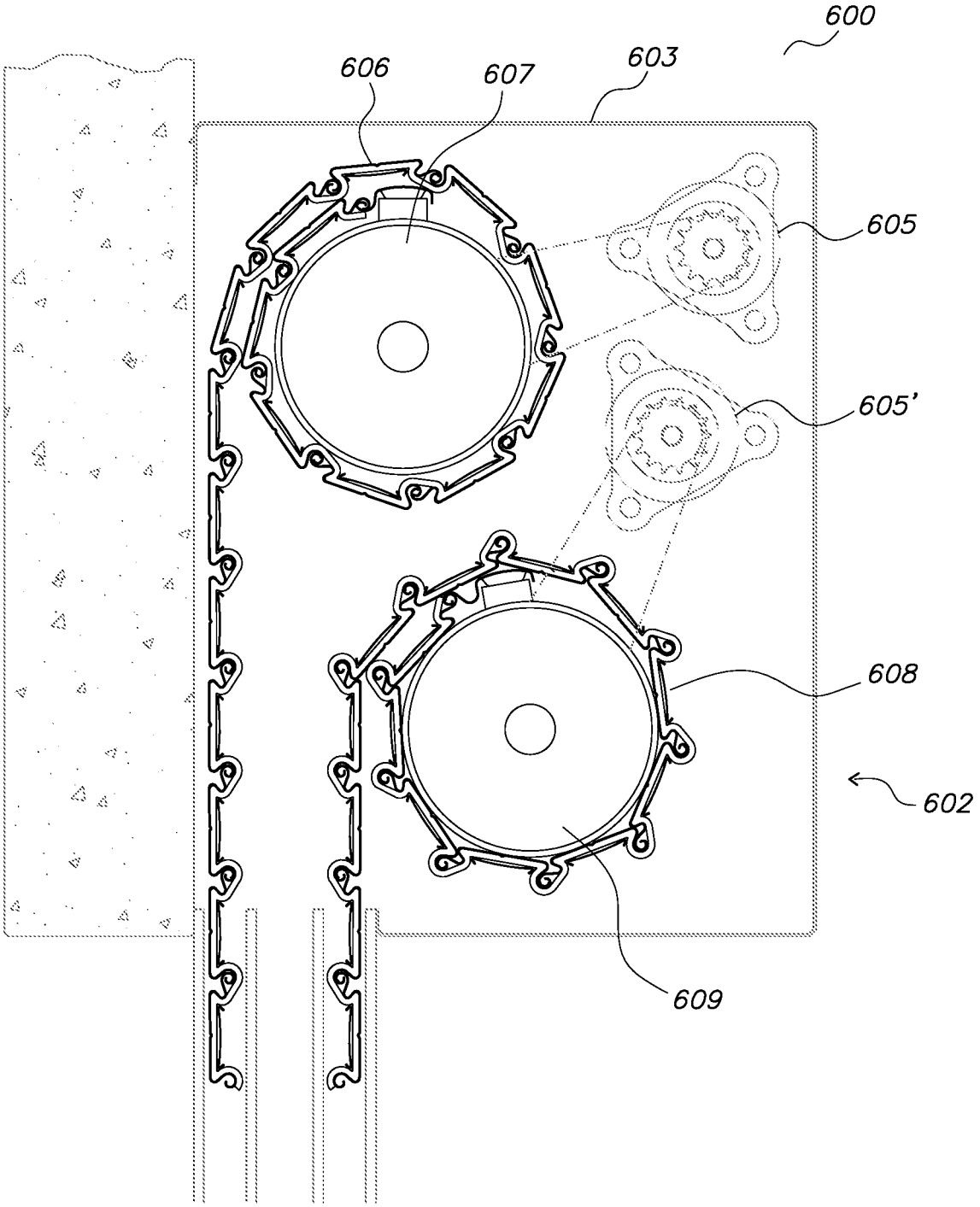
FIG. 6 shows a side cross-sectional view of an upper portion of a vertical roller shutter according to various embodiments.

FIG. 6 shows a side cross-sectional view of an upper portion 602 of a vertical roller shutter 600 according to various embodiments. The vertical roller shutter 600 of FIG. 6 differs from the vertical roller shutter 500 of FIG. 5A in that the first drum 607 of the first shutter curtain assembly 606 of roller shutter 600 may be driven by a first motor 605 and the second drum 609 of the second shutter curtain assembly 608 may be driven by a second motor 605'. Accordingly, in this configuration, the first drum 607 and the second drum 609 may be arranged such that the first drum 607 may be above the second drum 609 within the housing 603. Hence, the space between the first shutter curtain assembly 606 and the second shutter curtain assembly 608, when in the lowered state, may be reduced as compared to the vertical roller shutter 500 of FIG. 5A. As shown, the first motor 605 may drive the first drum 607 of the first shutter curtain assembly 606 of roller shutter 600 in a first direction (for example, clockwise direction from the view as shown in FIG. 6) for rolling in the first shutter curtain assembly 606, and the second motor 605' may drive the second drum 609 of the second shutter curtain assembly 608 of roller shutter 600 in the same first direction (for example, clockwise direction from the view as shown in FIG. 6) for rolling in the second shutter curtain assembly 608. Further, the first motor 605 may drive the first drum 607 of the first shutter curtain assembly 606 of roller shutter 600 in a second direction (for example, anti-clockwise direction from the view as shown in FIG. 6) for rolling out the first shutter curtain assembly 606, and the second motor 605' may drive the second drum 609 of the second shutter curtain assembly 608 of roller shutter 600 in the same second direction (for example, anti-clockwise direction from the view as shown in FIG. 6) for rolling out the second shutter curtain assembly 608. In addition, the first motor 605 and the second motor 605' may simultaneous drive the rotation of both the drums 607, 609 in a coordinated manner to roll in or roll out both the shutter curtain assemblies 606, 608 at the same time in a synchronized manner.

Figure 7:
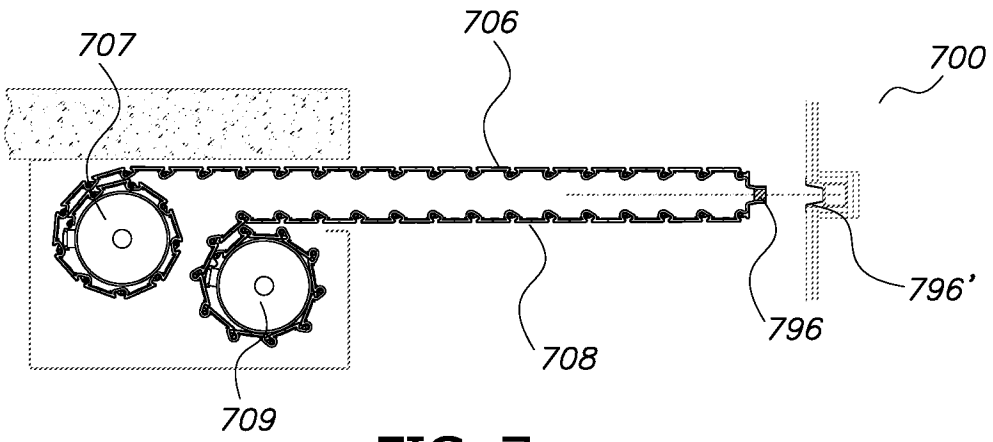
FIG. 7 shows a top cross-sectional view of a lateral roller shutter according to various embodiments.

FIG. 7 shows a top cross-sectional view of a lateral roller shutter 700 according to various embodiments. The lateral roller shutter 700 of FIG. 7 differs from the vertical roller shutters 500 of FIG. 5A and the roller shutter 600 of FIG. 6 in that the pair of shutter curtain assemblies 706, 708 of the lateral roller shutter 700 are arranged to be rolled in and out sideways instead of up and down. Accordingly, the respective drums 707, 709 and motors may be arranged with their respective rotational axis in a vertical orientation. Further, the lateral ends of the pair of shutter curtain assemblies 706, 708 may also differ from the foot components 590, 592 of the vertical roller shutter 500 of FIG. 5A in that the lateral ends of the pair of shutter curtain assemblies 706, 708 may be joined together by an insulating block 796. Furthermore, on the wall which the lateral roller shutter 700 closes, a striker 796' with recess to receive the insulating block may be provided.

Figure 8:
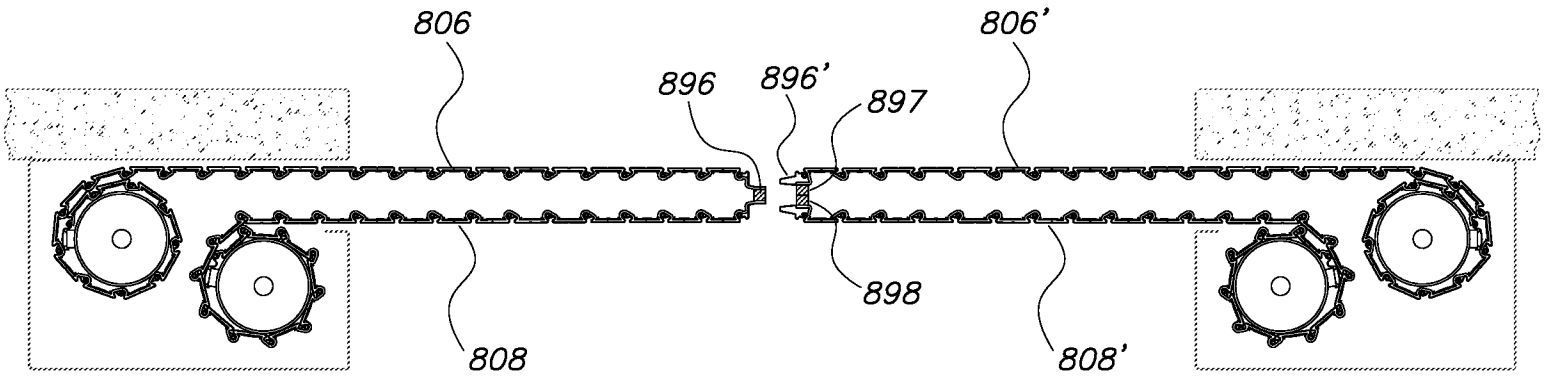
FIG. 8 shows a top cross-sectional view of a lateral roller shutter according to various embodiments.

FIG. 8 shows a top cross-sectional view of a lateral roller shutter 800 according to various embodiments. The lateral roller shutter 800 of FIG. 8 differs from the lateral roller shutter 700 of FIG. 7 in that two pairs of shutter curtain assemblies 806, 808, 806', 808' are provided. The first pair of shutter curtain assemblies 806, 808 may be arranged to close sideways from left to right, and the second pair of shutter curtain assemblies 806', 808' may be arranged to close sideways from right to left. The first pair of shutter curtain assemblies 806, 808 may, similar to the pair of shutter curtain assemblies 706, 708 of FIG. 7, include an insulating block 896 joining the lateral ends of the pair of shutter curtain assemblies 806, 808. On the other hand, the second pair of shutter curtain assemblies 806', 808' may include a latch 896' configured to receive the joined lateral ends of the first pair of shutter curtain assemblies 806, 808. The latch 896' may include one or more insulating blocks 897, 898 between the jaws of the latch 896'.

Figure 9:
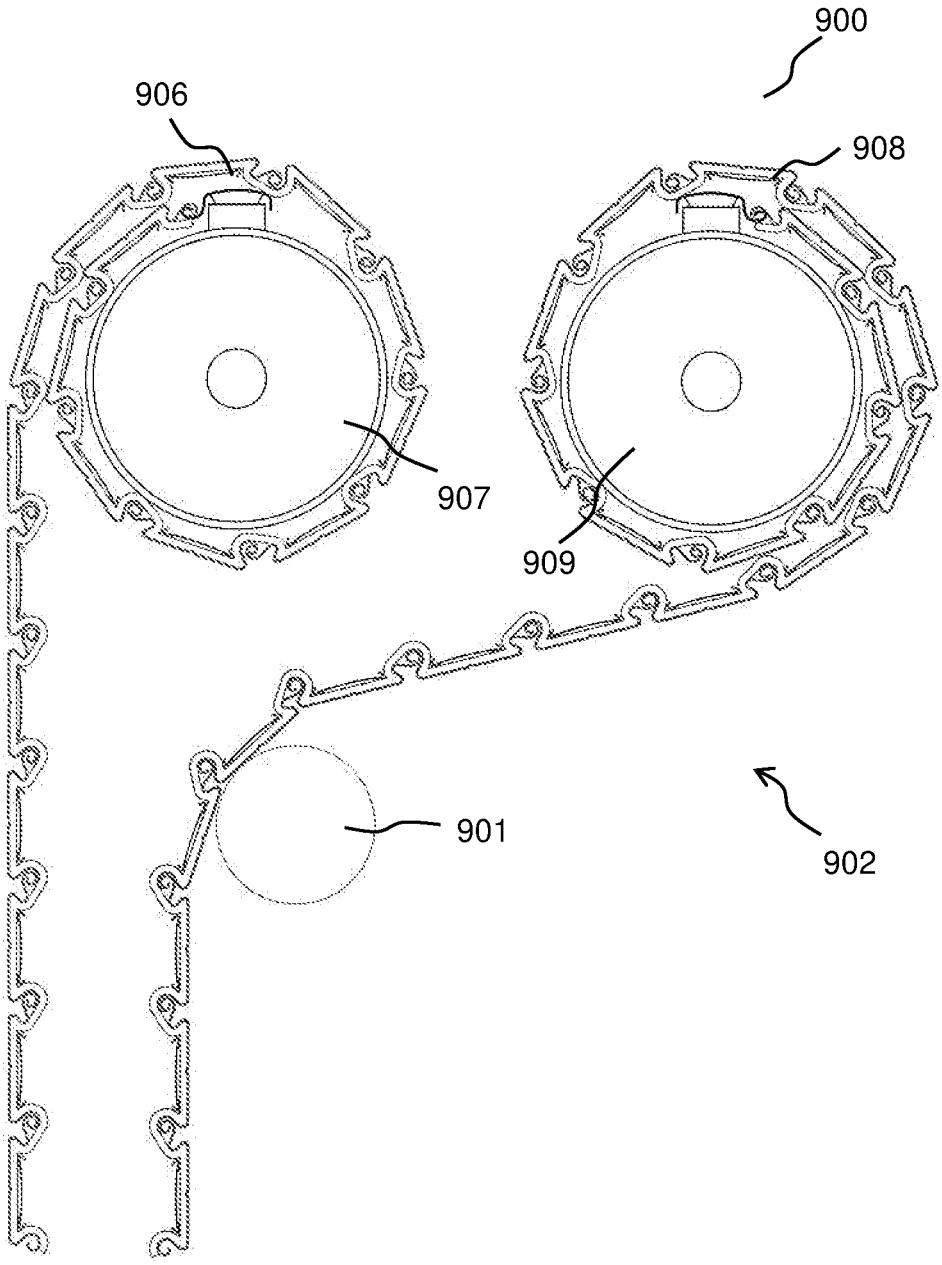
FIG. 9 shows a schematic side view of an upper portion of a vertical roller shutter according to various embodiments.

FIG. 9 shows a schematic side view of an upper portion 902 of a vertical roller shutter 900 according to various embodiments. As shown, the vertical roller shutter 900 may include a pair of shutter curtain assemblies 906, 908. The vertical roller shutter 900 may be configured such that the pair of shutter curtain assemblies 906, 908 may be raised up and lowered down vertically. Accordingly, when in the lowered state, the pair of shutter curtain assemblies 906, 908 may be spaced apart and parallel to each other such that the pair of shutter curtain assemblies 906, 908 may be facing each other. According to various embodiments, each of the pair of shutter curtain assemblies 906, 908 may be the shutter curtain assembly 300 of FIG. 3A & FIG. 3B, and/or the shutter curtain assembly 400 of FIG. 4. According to various embodiments, the respective insulating layers of the respective shutter curtain assemblies 906, 908 may be lined on respective surfaces of the respective shutter curtain assemblies 906, 908 such that they are facing each other. According to various embodiments, the vertical roller shutter 900 of FIG. 9 differs from the vertical roller shutter 500 of FIG. 5A in that the vertical roller shutter 900 of FIG. 9 includes two counter-rotating drums 907, 909 arranged side-by-side. Accordingly, the first shutter curtain assembly 906 may be attached to and wound round the first counter-rotating drum 907 in a first direction (for example, wound round in a clockwise direction) and the second shutter curtain assembly 908 may be attached to and wound round the second counter-rotating drum 909 in a second direction (for example, wound round in an anti-clockwise direction). The first direction and the second direction are opposite directions. Hence, in this configuration, the first and second counter-rotating drums 907, 909 may be configured to rotate in a first set of opposite directions (for example, the first drum 907 in clockwise direction and the second drum 909 in anti-clockwise direction) for rolling in both the shutter curtain assemblies 906, 908. Further, both the first and second counter-rotating drums 907, 909 may rotate in a second set of opposite directions (for example, the first drum 907 in anti-clockwise direction and the second drum 909 in clockwise direction) for rolling out both the shutter curtain assemblies 906, 908. According to various embodiments, the vertical roller shutter 900 may include a roller 901 disposed below the first drum 907. Accordingly, the second shutter curtain assembly 908 on the second drum 909 may run from the second drum 909 and around the roller 901 such that a space between the first shutter curtain assembly 906 and the second shutter curtain assembly 908, when in the lowered state, may be reduced as compared to the vertical roller shutter 500 of FIG. 5A.

Figures 10A, 10B, 10C:
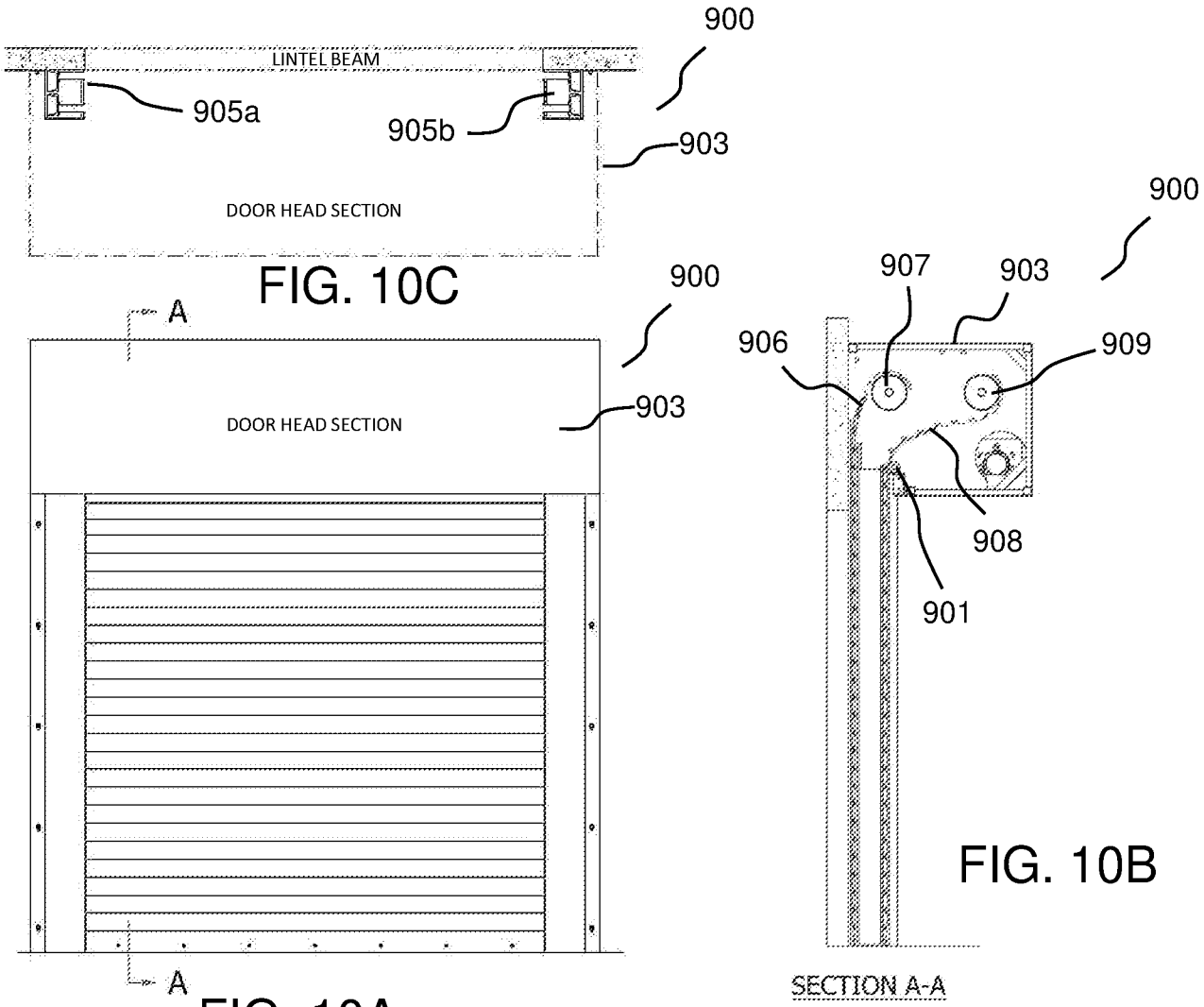
FIG. 10A and FIG. 10B show a front view and a cross-sectional side view of a vertical roller shutter, in a lowered state, according to various embodiments.
FIG. 10C shows the positions of motor assemblies from a top view of the vertical roller shutter of FIG. 10A according to various embodiments.
Figure 10D:
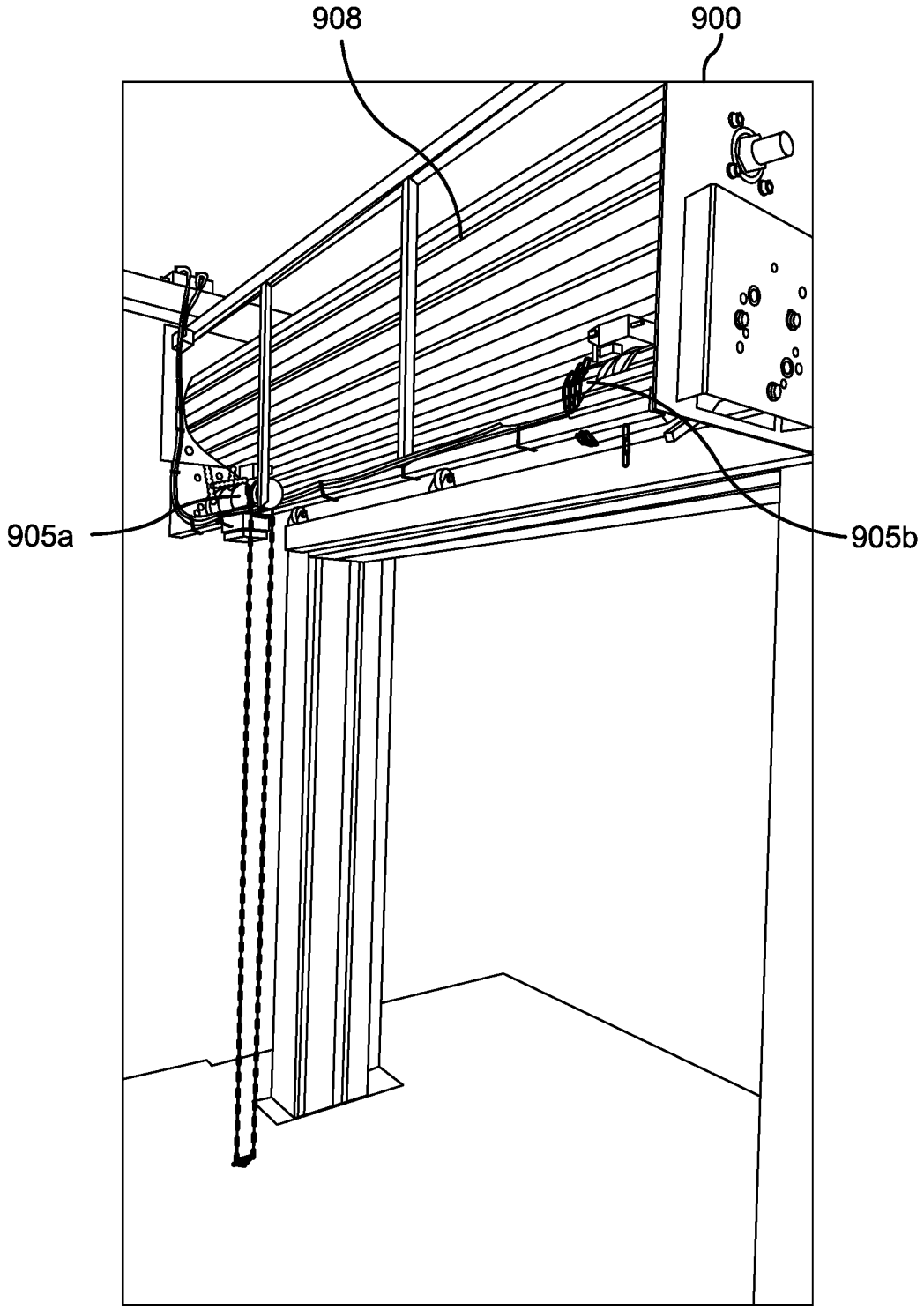
FIG. 10D shows a photograph of an actual implementation of the vertical roller shutter of FIG. 10A according to various embodiments.

FIG. 10A and FIG. 10B show a front view and a cross-sectional side view of the vertical roller shutter 900, in a lowered state, according to various embodiments. FIG. 10C shows the positions of motor assemblies 905*a*, 905*b* from a top view of the vertical roller shutter 900 according to various embodiments. FIG. 10D shows a photograph of an actual implementation of the vertical roller shutter 900 according to various embodiments. As shown, the vertical roller shutter 900 may include two motor assemblies 905*a*, 905*b* arranged in a housing 903 (or a door head section) of the vertical roller shutter 900. The first motor assembly 905*a* may be on one end of the housing 903 of the vertical roller shutter 900 and the second motor assembly 905*b* may be on an opposite end of the housing 903 of the vertical roller shutter 900. According to various embodiments, the first motor assembly 905*a* may be configured to drive the first drum 907 and the second motor assembly 905*b* may be configured to drive the second drum 909. According to various embodiments, a belt or a chain mechanism may couple each of the drums 907, 909 to the respective motor assemblies 905*a*, 905*b*. According to various embodiments, the first and second motor assemblies 905*a*, 905*b* may be configured to simultaneously drive the rotation of both the drums 907, 909 in a coordinated manner to roll in or roll out both the shutter curtain assemblies 906, 908 at the same time in a synchronized manner.

Figure 11A:
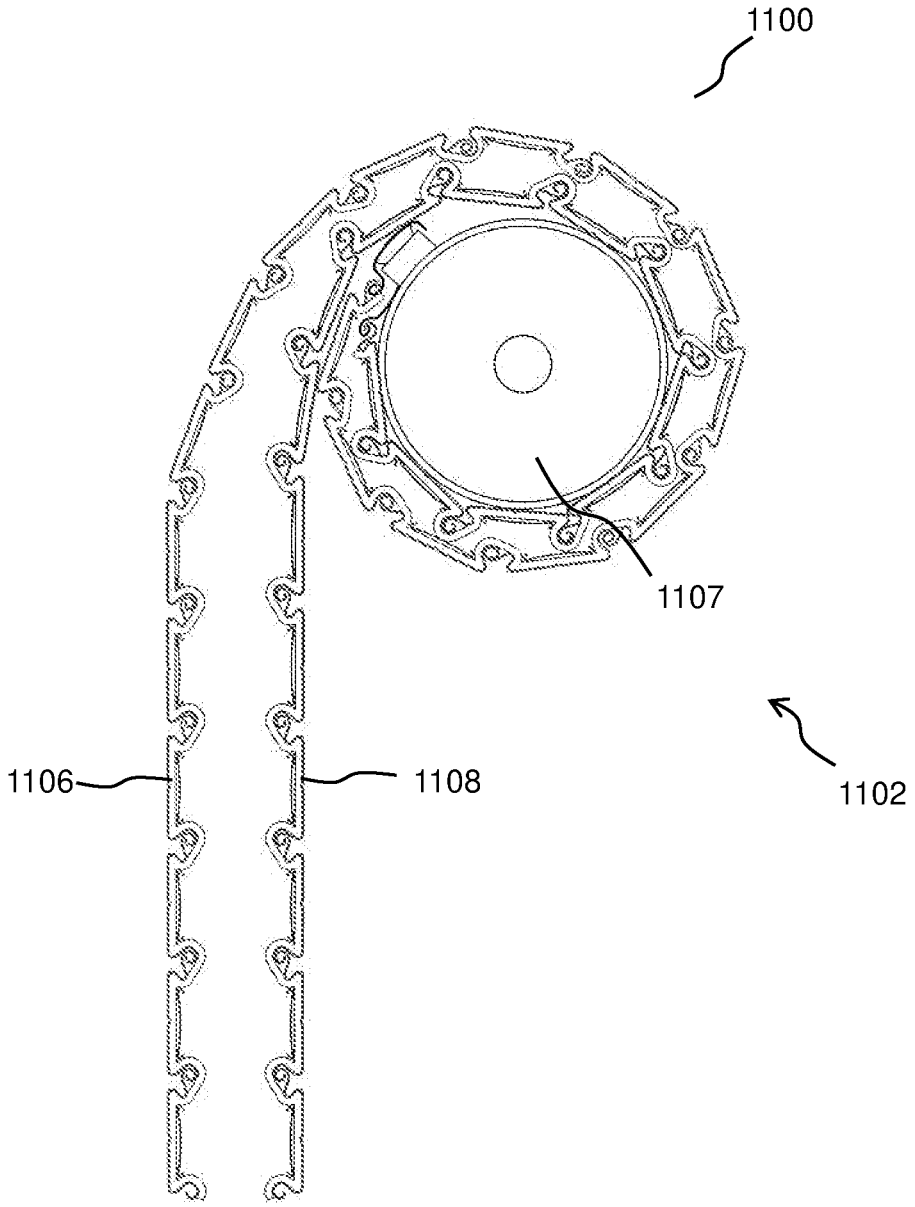
FIG. 11A shows a schematic side view of an upper portion of a vertical roller shutter according to various embodiments.
Figure 11B:
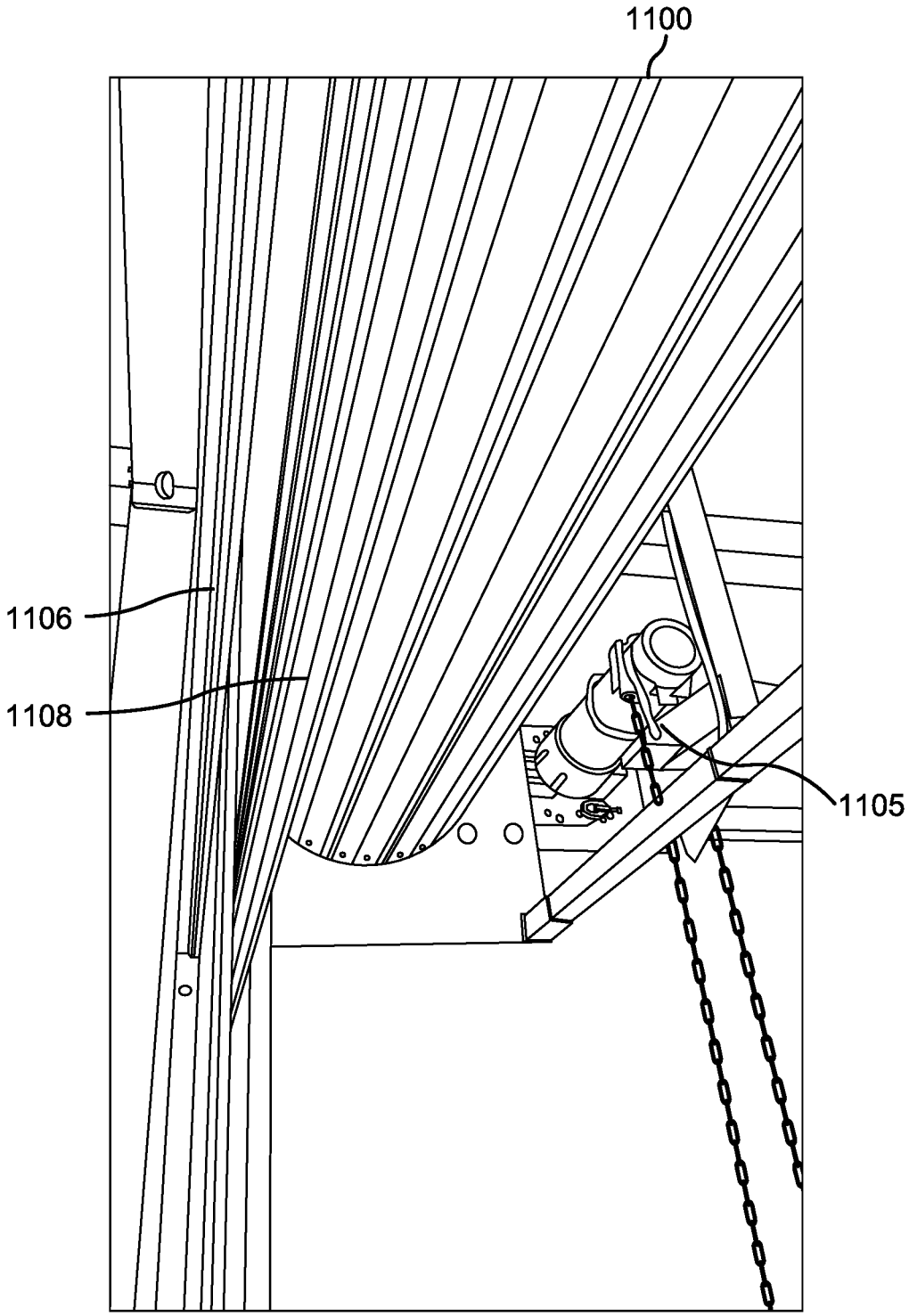
FIG. 11B shows a photograph of an actual implementation of the vertical roller shutter of FIG. 11A according to various embodiment.

FIG. 11A shows a schematic side view of an upper portion 1102 of a vertical roller shutter 1100 according to various embodiments. FIG. 11B shows a photograph of an actual implementation of the vertical roller shutter 1100 according to various embodiments. As shown, the vertical roller shutter 1100 may include a pair of shutter curtain assemblies 1106, 1108. The vertical roller shutter 1100 may be configured such that the pair of shutter curtain assemblies 1106, 1108 may be raised up and lowered down vertically. Accordingly, when in the lowered state, the pair of shutter curtain assemblies 1106, 1108 may be spaced apart and parallel to each other such that the pair of shutter curtain assemblies 1106, 1108 may be facing each other. According to various embodiments, each of the pair of shutter curtain assemblies 1106, 1108 may be the shutter curtain assembly 300 of FIG. 3A & FIG. 3B, and/or the shutter curtain assembly 400 of FIG. 4. According to various embodiments, the respective insulating layers of the respective shutter curtain assemblies 1106, 1108 may be lined on respective surfaces of the respective shutter curtain assemblies 1106, 1108 such that they are facing each other. According to various embodiments, the vertical roller shutter 1100 may include one single drum 1107. Accordingly, both the first shutter curtain assembly 1106 and the second shutter curtain assembly 1108 may be attached to and wound round the drum 1107. The first shutter curtain assembly 1106 and the second shutter curtain assembly 1108 may be arranged such that the respective insulating layers are facing each other when both the first shutter curtain assembly 1106 and the second shutter curtain assembly 1108 are wound round the drum 1107. According to various embodiments, the first shutter curtain assembly 1106 and the second shutter curtain assembly 1108 may be attached to the drum 1107 in a manner such that both the shutter curtain assemblies 1106, 1108 may be rolled in or rolled out at the same time in a synchronized manner. According to various embodiments, the first shutter curtain assembly 1106 and the second shutter curtain assembly 1108 may be attached to the drum 1107 in a staggered manner (for example, at different positions along a circumference of the drum 1107 one after another) to facilitate rolling in or rolling out in a synchronized manner.

According to various embodiments, the vertical roller shutter 1100 may include a motor assembly 1105. According to various embodiments, a belt or a chain mechanism may couple the drum 1107 to the motor assembly 1105 such that the motor assembly 1105 may drive the rotation of the drums 1107 to roll in or roll out both the shutter curtain assemblies 1106, 1108 at the same time in a synchronized manner. Accordingly, the motor assembly 1105 may drive the drum 1107 to rotate in a first direction (for example, clockwise direction) for rolling in both the shutter curtain assemblies 1106, 1108, and drive the drum 1107 to rotate in a second direction (for example, anti-clockwise direction) for rolling out both the shutter curtain assemblies 1106, 1108.

Figure 12A:
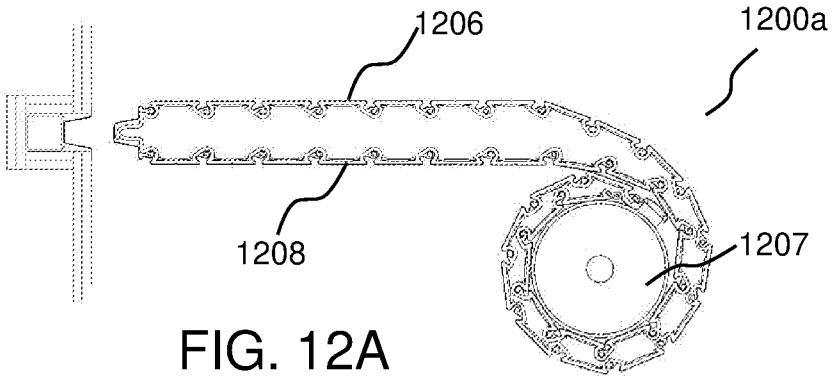
FIG. 12A shows a top cross-sectional view of a lateral roller shutter according to various embodiments.

FIG. 12A shows a top cross-sectional view of a lateral roller shutter 1200*a* according to various embodiments. The lateral roller shutter 1200*a* of FIG. 12A differs from the lateral roller shutters 700 of FIG. 7 in that the lateral roller shutter 1200 includes only one single drum 1207 on which the two curtain assemblies 1206 and 1208 are attached in a manner so as to be rolled in and out sideways. The other components of the lateral roller shutter 1200 is the same as that of the lateral roller shutters 700 of FIG. 7.

Figure 12B:
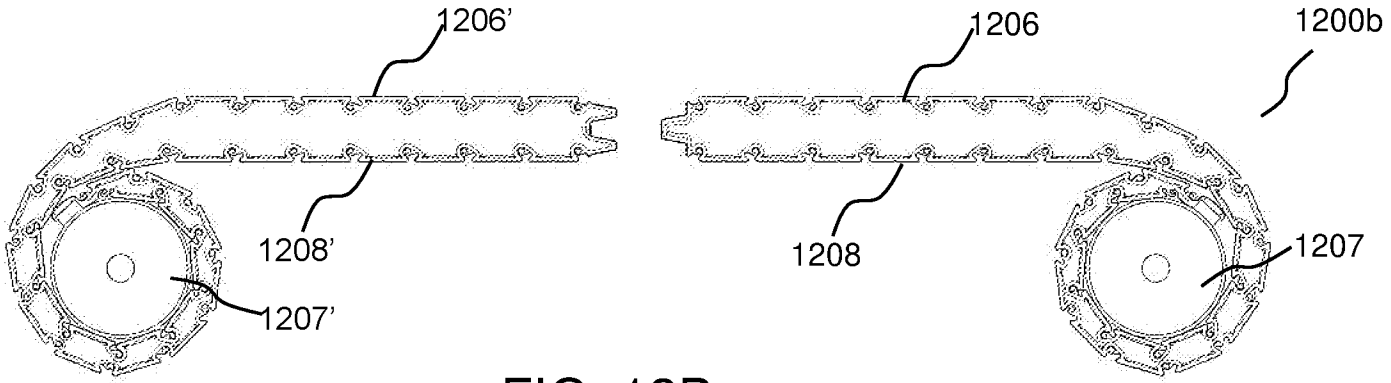
FIG. 12B shows a top cross-sectional view of a lateral roller shutter according to various embodiments.

FIG. 12B shows a top cross-sectional view of a lateral roller shutter 1200*b* according to various embodiments. The lateral roller shutter 1200*b* of FIG. 12B differs from the lateral roller shutter 1200*a* of FIG. 12A in that two pairs of shutter curtain assemblies 1206, 1208, 1206', 1208' are provided. The first pair of shutter curtain assemblies 1206', 1208' is provided on a first drum 1207'. The second pair of shutter curtain assemblies 1206, 1208 is provided on a second drum 1207. The first pair of shutter curtain assemblies 1206', 1208' may be arranged to close sideways from left to right by rotating the first drum 1207' in a first direction (for example, a clockwise direction from the view as shown in FIG. 12B), and the second pair of shutter curtain assemblies 1206, 1208 may be arranged to close sideways from right to left by rotating the second drum 1207 in a second direction (for example, an anti-clockwise direction from the view as shown in FIG. 12B). The second pair of shutter curtain assemblies 1206, 1208 of FIG. 12B may be similar to the pair of shutter curtain assemblies 1206, 1208 of FIG. 12A.

Figure 14A:
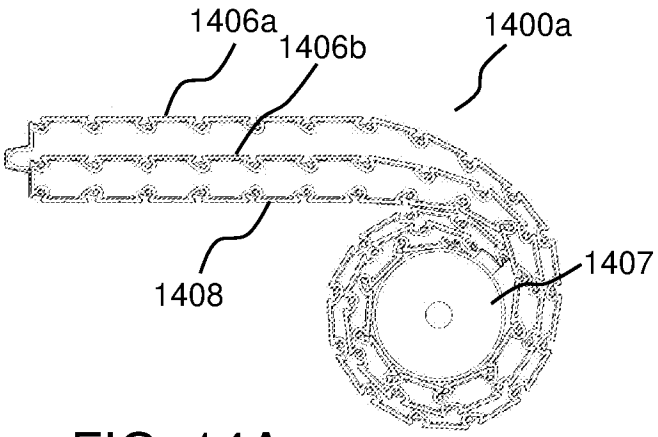
FIG. 14A shows a top cross-sectional view of a lateral roller shutter according to various embodiments.
Figure 14B:
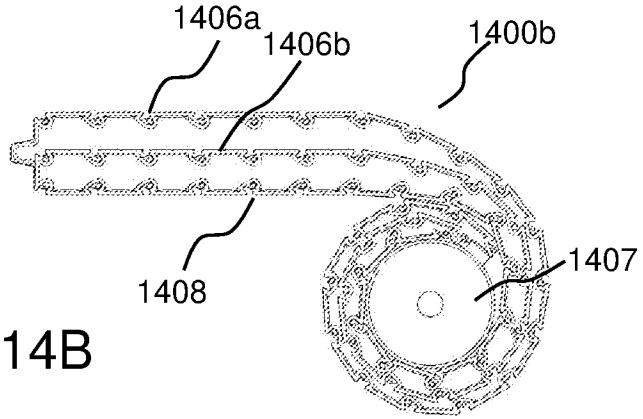
FIG. 14B shows a top cross-sectional view of a lateral roller shutter according to various embodiments.
Figure 13:
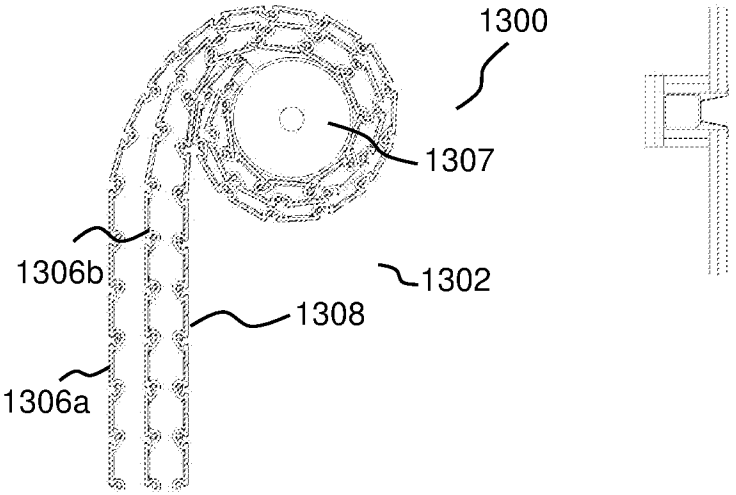
FIG. 13 shows a schematic side view of an upper portion of a vertical roller shutter according to various embodiments.
Figure 13:
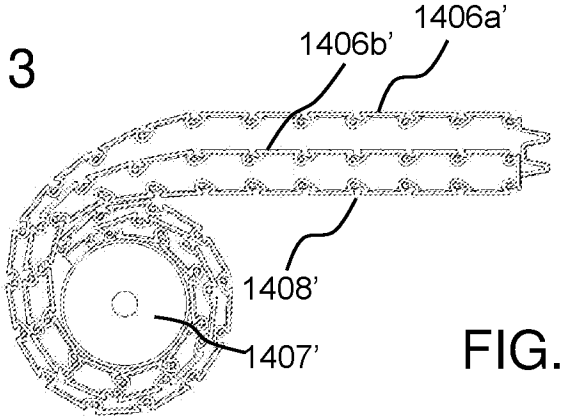

FIG. 13 shows a schematic side view of an upper portion 1302 of a vertical roller shutter 1300 according to various embodiments. The vertical roller shutter 1300 of FIG. 13 is similar to the vertical roller shutter 1100 of FIG. 11A except that the vertical roller shutter 1300 includes three shutter curtain assemblies 1306*a*, 1306*b*, 1308, attached to and wound round one single drum 1307. FIG. 14A shows a top cross-sectional view of a lateral roller shutter 1400*a* according to various embodiments. The lateral roller shutter 1400*a* of FIG. 14A is similar to the lateral roller shutter 1200 a of FIG. 12A except that the lateral roller shutter 1400*a* of FIG. 14A includes three shutter curtain assemblies 1406*a*, 1406*b*, 1408, attached to and wound round one single drum 1407. FIG. 14B shows a top cross-sectional view of a lateral roller shutter 1400*b* according to various embodiments. The lateral roller shutter 1400*b* of FIG. 14B is similar to the lateral roller shutter 1200*b* of FIG. 12B except that the lateral roller shutter 1400*b* includes two sets of three shutter curtain assemblies 1406*a*, 1406*b*, 1408, 1406*a*', 1406*b*', 1408', wherein each set of three shutter curtain assemblies is attached to and wound round one single drum 1407, 1407'.

FIG. 15A and FIG. 15B show side views of two slats 1510*a*, 1510*b* pivotably interlocked to each other in a suspended mode and in a stacked mode respectively according to various embodiments. FIG. 15C and FIG. 15D shows perspective views of the two slats 1510*a*, 1510*b* in the suspended mode and in the stacked mode respectively according to various embodiments. According to various embodiments, interlocking elements of each slat 1510*a*, 1510*b* may be configured such that some lateral leeway (or freedom of lateral movement or side-way movement) may be provided when two slats 1510*a*, 1510*b* are pivotably interlocked to each other in a side-by-side manner. Accordingly, the lateral leeway may allow the two slats 1510*a*, 1510*b* to be extended laterally from each other while remaining interlocked in the suspended mode. The lateral leeway may also allow the two slats 1510*a*, 1510*b* to close in laterally on each other while being interlocked so as to be stacked together in the stacked mode. According to various embodiments, lateral leeway may be freedom of movements allowed in a direction perpendicular to respective longitudinal axis of the respective slat.

As shown, each of the slat 1510*a*, 1510*b* may, similar to the slat 110 of FIG. 1C and FIG. 1D, include a main portion 1512*a*, 1512*b* between a first longitudinal edge portion 1514*a*, 1514*b* and a second longitudinal edge portion 1516*a*, 1516*b*. Accordingly, the main portion 1512*a* of the slat 1510*a* may be the main body of the slat 1510*a* for lining abreast or placing side by side with the main portion 1512*b* of the adjacent slat 1510*b* so as to form a shutter curtain. According to various embodiments, a shutter curtain assembly may include a plurality of slats 1510*a*, 1510*b* pivotally interlocked one after another.

As shown, each of the slat 1510*a*, 1510*b* may include a first receiving portion 1530*a*, 1530*b* which may be an inward bend 1532*a*, 1532*b* (or inward fold) at the first longitudinal edge portion 1514*a*, 1514*b* of the respective slat 1510*a*, 1510*b*. According to various embodiments, each slat 1510*a*, 1510*b* may be formed or shaped or profiled or made or molded or pressed from an elongated sheet of material, such as an elongated sheet of metal. Accordingly, the inward bend 1532*a*, 1532*b* at the first longitudinal edge portion 1514*a*, 1514*b* may be formed from bending or folding a first longitudinal edge 1513*a*, 1513*b* of the sheet of material lengthwise inwardly towards a longitudinal axis 1511*a*, 1511*b* of the respective slat 1510*a*, 1510*b*. Hence, the inward bend 1532*a*, 1532*b* may be immediately adjacent to the main portion 1512*a*, 1512*b* of the respective slat 1510*a*, 1510*b*. As shown, a first elongate overhang portion 1531*a*, 1531*b* of the respective slat 1510*a*, 1510*b* may extend laterally from the inward bend 1532*a*, 1532*b* of the first longitudinal edge portion 1514*a*, 1514*b* such that the first elongate overhang portion 1531*a*, 1531*b* of the respective slat 1510*a*, 1510*b* may be angled less than 90° with respect to the main portion 1512*a*, 1512*b* of the respective slat 1510*a*, 1510*b*. Accordingly, the first elongate overhang portion 1531*a*, 1531*b* of the respective slat 1510*a*, 1510*b* and the main portion 1512*a*, 1512*b* of the respective slat 1510*a*, 1510*b* may form a groove with a V-shaped or U-shaped or a horse-shoe-shaped cross-section, and the inward bend 1532*a*, 1532*b* of the first longitudinal edge portion 1514*a*, 1514*b* of the respective slat 1510*a*, 1510*b* may be of an acute angle.

As shown, each of the slat 1510*a*, 1510*b* may include a second receiving portion 1540*a*, 1540*b* which may be an inward bend 1542*a*, 1542*b* (or inward fold) at a second longitudinal edge portion 1516*a*, 1516*b* of the respective slat 1510*a*, 1510*b*. According to various embodiments, the inward bend 1542*a*, 1542*b* at the second longitudinal edge portion 1516*a*, 1516*b* may be formed from bending or folding a second longitudinal edge 1515*a*, 1515*b* of the sheet of material lengthwise inwardly towards the longitudinal axis 1511*a*, 1511*b* of the respective slat 1510*a*, 1510*b*. Accordingly, the inward bend 1542*a*, 1542*b* may be immediately adjacent to the main portion 1512*a*, 1512*b* of the respective slat 1510*a*, 1510*b*. As shown, a second elongate overhang portion 1541*a*, 1541*b* of the respective slat 1510*a*, 1510*b* may extend laterally from the inward bend 1542*a*, 1542*b* of the second longitudinal edge portion 1516*a*, 1516*b*. As shown, a first segment 1541*a*', 1541*b*' of the second elongate overhang portion 1541*a*, 1541*b* may extend laterally from the inward bend 1542*a*, 1542*b* of the second longitudinal edge portion 1516*a*, 1516*b* such that the first segment 1541*a*', 1541*b*' of the second elongate overhang portion 1541*a*, 1541*b* of the respective slat 1510*a*, 1510*b* may be angled less than 90° with respect to the main portion 1512*a*, 1512*b* of the respective slat 1510*a*, 1510*b*. Further, a second segment 1541*a*", 1541*b*" of the second elongate overhang portion 1541*a*, 1541*b* may extend laterally from the first segment 1541*a*', 1541*b*' of the second elongate overhang portion 1541*a*, 1541*b* such that the second segment 1541*a*", 1541*b*" of the second elongate overhang portion 1541*a*, 1541*b* may be angled between 90° to 180° (or form an obtuse angle) with respect to the first segment 1541*a*', 1541*b*' of the second elongate overhang portion 1541*a*, 1541*b* of the respective slat 1510*a*, 1510*b*. Accordingly, the first segment 1541*a*', 1541*b*' of the second elongate overhang portion 1541*a*, 1541*b* of the slat 1510*a*, 1510*b* and the main portion 1512*a*, 1512*b* of the respective slat 1510*a*, 1510*b* may form a groove with a V-shaped or U-shaped or horse-shoe-shaped cross-section, and the inward bend 1542*a*, 1542*b* of the second longitudinal edge portion 1516*a*, 1516*b* of the respective slat 1510*a*, 1510*b* may of an acute angle. According to various embodiments, the second segment 1541*a*", 1541*b*" of the second elongate overhang portion 1541*a*, 1541*b* may be parallel to the main portion 1512*a*, 1512*b* of the respective slat 1510*a*, 1510*b*.

As shown, the pair of inward bends 1532*a*, 1542*a*, 1532*b*, 1542*b* at the respective first longitudinal edge portion 1514*a*, 1514*b* and the second longitudinal edge portion 1516*a*, 1516*b* may extend through the entire length of the respective slat 1510*a*, 1510*b* and may be at least substantially parallel to each other. According to various other embodiments, the inward bend at the first longitudinal edge portion and the inward bend at the second longitudinal edge portion may extend along only a portion of the length of the respective slat. According to various other embodiments, the pair of inward bends may also be non-parallel to each other.

According to various embodiments, the inward bend 1532*a*, 1532*b* at the first longitudinal edge portion 1514*a*, 1514*b* and the inward bend 1542*a*, 1542*b* at the second longitudinal edge portion 1516*a*, 1516*b* may form a pair of grooves 1534*a*, 1544*a*, 1534*b*, 1544*b* which may be opposing each other and which may have a V-shaped or U-shaped or a horse-shoe-shaped cross-section. Accordingly, the pair of grooves 1534*a*, 1544*a*, 1534*b*, 1544*b* may be a pair of inwardly bent portions (or folded portions) of the respective slat 1510*a*, 1510*b*. Each of the pair of inwardly bent portions of the respective slat 1510*a*, 1510*b* may be formed from bending inwardly towards the longitudinal axis of the respective slat 1510*a*, 1510*b* so as to form the acute angle.

As shown in FIG. 15A and FIG. 15B, the inward bend 1532*a*, 1532*b* at the first longitudinal edge portion 1514*a*, 1514*b* of the respective slat 1510*a*, 1510*b* may be followed by an outward bend 1518*a*, 1518*b* (or outward fold) formed from subsequent bending or folding of the first longitudinal edge 1513*a*, 1513*b* of the elongated sheet of material lengthwise away from the longitudinal axis 1511*a*, 1511*b* of the respective slat 1510*a*, 1510*b*. Accordingly, from the first elongate overhang portion 1531*a*, 1531*b*, the sheet of material may be bent or folded outwardly away from the longitudinal axis 1511*a*, 1511*b* of the respective slat 1510*a*, 1510*b* to form the outward bend 1518*a*, 1518*b*. As shown, a first elongate winged-like portion 1519*a*, 1519*b* of the respective slat 1510*a*, 1510*b* may extend laterally from the outward bend 1518*a*, 1518*b*. A first segment 1519*a*', 1519*b*' of the first elongate winged-like portion 1519*a*, 1519*b* of the respective slat 1510*a*, 1510*b* may extend laterally from the outward bend 1518*a*, 1518*b* such that the first segment 1519*a*', 1519*b*' of the first elongate winged-like portion 1519*a*, 1519*b* of the respective slat 1510*a*, 1510*b* may be angled less than 90° with respect to the first elongate overhang portion 1531*a*, 1531*b* of the respective slat 1510*a*, 1510*b*. Accordingly, a first segment 1519*a*', 1519*b*' of the first elongate winged-like portion 1519*a*, 1519*b* of the respective slat 1510*a*, 1510*b* and the first elongate overhang portion 1531*a*, 1531*b* of the respective slat 1510*a*, 1510*b* may form a V-shaped or U-shaped cross-section, and the outward bend 1518*a*, 1518*b* of the first longitudinal edge portion 1514*a*, 1514*b* of the respective slat 1510*a*, 1510*b* may be of an acute angle. Further, a second segment 1519*a*", 1519*b*" of the first elongate winged-like portion 1519*a*, 1519*b* of the respective slat 1510*a*, 1510*b* may extend laterally from the first segment 1519*a*', 1519*b*' of the first elongate winged-like portion 1519*a*, 1519*b* such that the second segment 1519*a*", 1519*b*" of the first elongate winged-like portion 1519*a*, 1519*b* may be angled between 90° to 180° (or form an obtuse angle) with respect to the first segment 1519*a*', 1519*b*' of the first elongate winged-like portion 1519*a*, 1519*b* of the respective slat 1510*a*, 1510*b*.

According to various embodiments, the first elongate winged-like portion 1519*a*, 1519*b* of the first longitudinal edge portion 1514*a*, 1514*b* of the respective slat 1510*a*, 1510*b* may be followed by an inward curl 1520*a*, 1520*b* formed from subsequent curling of the first longitudinal edge 1513*a*, 1513*b* of the elongated sheet of material lengthwise inwardly towards the longitudinal axis 1511*a*, 1511*b* of the respective slat 1510*a*, 1510*b*. Accordingly, from the first elongate winged-like portion 1519*a*, 1519*b* of the slat 1510*a*, 1510*b*, the sheet of material may be curled inwardly towards the longitudinal axis 1511*a*, 1511*b* of the respective slat 1510*a*, 1510*b*. Hence, the inward curl 1520*a*, 1520*b* may form a first curled edge portion of the respective slat 1510*a*, 1510*b*. The first curled edge portion of the respective slat 1510*a*, 1510*b* may be a first interlocking element of the respective slat 1510*a*, 1510*b*. Accordingly, the first curled edge portion of the first slat 1510*a*, may be configured for engaging, interlocking, or interacting with a corresponding interlocking element of the second slat 1510*b* to pivotably join the two slats 1510*a*, 1510*b* together. According to various embodiments, the first longitudinal edge portion 1514*a*, 1514*b* of the respective slat 1510*a*, 1510*b* may include the inward bend 1532*a*, 1532*b*, the first elongate overhang portion 1531*a*, 1531*b*, the outward bend 1518*a*, 1518*b*, the first elongate winged-like portion 1519*a*, 1519*b*, and the inward curl 1520*a*, 1520*b*.

Further, as also shown, the second elongate overhang portion 1541*a*, 1541*b* at the second longitudinal edge portion 1516*a*, 1516*b* of the respective slat 1510*a*, 1510*b* may be followed by an at least substantially semi-circular outward curl 1522*a*, 1522*b* formed from subsequent curling of the second longitudinal edge 1515*a*, 1515*b* of the elongated sheet of material lengthwise outwardly away from the longitudinal axis 1511*a*, 1511*b* of the respective slat 1510*a*, 1510*b*. Accordingly, from the second elongate overhang portion 1541*a*, 1541*b*, the sheet of material may be curled outwardly away in a semi-circular manner from the longitudinal axis 1511*a*, 1511*b* of the respective slat 1510*a*, 1510*b* to form the semi-circular outward curl 1522*a*, 1522*b*. Further, a second elongate winged-like portion 1521*a*, 1521*b* of the respective slat 1510*a*, 1510*b* may extend laterally from the semi-circular outward curl 1522*a*, 1522*b* such that the second elongate winged-like portion 1521*a*, 1521*b* may be parallel to the main portion 1512*a*, 1512*b* of the respective slat 1510*a*, 1510*b*. Furthermore, the second elongate winged-like portion 1521*a*, 1521*b* at the second longitudinal edge portion 1516*a*, 1516*b* of the respective slat 1510*a*, 1510*b* may be followed by a backward curl 1523*a*, 1523*b* formed from subsequent curling of the second longitudinal edge 1515*a*, 1515*b* of the elongated sheet of material lengthwise away from the longitudinal axis 1511*a*, 1511*b* and looping backwards towards the longitudinal axis 1511*a*, 1511*b* of the respective slat 1510*a*, 1510*b*. Accordingly, from the second elongate winged-like portion 1521*a*, 1521*b*, the sheet of material may be curled away and then looped from the back towards the longitudinal axis 1511*a*, 1511*b* of the respective slat 1510*a*, 1510*b* to form the backward curl 1523*a*, 1523*b*. The semi-circular outward curl 1522*a*, 1522*b*, the second elongate winged-like portion 1521*a*, 1521*b*, and the backward curl 1523*a*, 1523*b* may, together, form a second curled edge portion of the respective slat 1510*a*, 1510*b*. The second curled edge portion of the slat 1510*a*, 1510*b* may be a second interlocking element of the respective slat 1510*a*, 1510*b*. According to various embodiments, the second curled edge portion of the first slat 1510*a* may be configured for engaging, interlocking, or interacting with the first curled edge portion of the second slat 1510*b* to pivotably join the two slats 1510*a*, 1510*b* together. According to various embodiments, the second longitudinal edge portion 1516*a*, 1516*b* of the respective slat 1510*a*, 1510*b* may include the inward bend 1542*a*, 1542*b*, the second elongate overhang portion 1541*a*, 1541*b*, the semi-circular outward curl 1522*a*, 1522*b*, the second elongate winged-like portion 1521*a*, 1521*b*, and the backward curl 1523*a*, 1523*b*.

According to various embodiments, a curl radius of the inward curl 1520*a*, 1520*b* at the first longitudinal edge portion 1514*a*, 1514*b* may be smaller than a curl radius of the semi-circular outward curl 1522*a*, 1522*b* at the second longitudinal edge portion 1516*a*, 1516*b*. Further, a curl radius of the backward curl 1521*a*, 1521*b* at the second longitudinal edge portion 1516*a*, 1516*b* may be smaller than the curl radius of the inward curl 1520*a*, 1520*b* at the first longitudinal edge portion 1514*a*, 1514*b*. Accordingly, two adjacent slats 1510*a*, 1510*b* may be joined together by, for example, overlapping, fitting, interlocking, engaging, interacting or joining of an inward curl at a first longitudinal edge portion of a first slat to an outward curl at a second longitudinal edge portion of a second slat and a backward curl at the second longitudinal edge portion of the second slat to the inward curl at the first longitudinal edge portion of the first slat such that the first slat may be pivotably joined to the second slat. According to various embodiments, each slat may be configured to overlap or fit or interlock or joined with a further slat, one after another in a series, so as to form a shutter curtain.

As shown in FIG. 15A and FIG. 15C, in use, the joined slats 1510*a*, 1510*b* may be in a suspended mode whereby the second slat 1510*b* (or the lower slat) may hang from the first slat 1510*a* (or the upper slat). This may occur, for example, when a shutter curtain formed from interlocking two or more slats 1510*a*, 1510*b* in the manner as described with reference to FIG. 15A to 15D is being rolled in or rolled out from a drum of a shutter assembly. According to various embodiments, in the suspended mode, the inward curl 1520*b* of the first longitudinal edge portion 1514*b* of the second slat 1510*b* may be in engagement with the backward curl 1523*a* of the second longitudinal edge portion 1516*a* of the first slat 1510*a*. Accordingly, the second slat 1510*b* may be pivotably hung from the first slat 1510*a*.

As shown in FIG. 15B and FIG. 15D, in use, the joined slats 1510*a*, 1510*b* may be in a stacked mode whereby the first slat 1510*a* (or the upper slat) may be stacked or sit or rested on the second slat 1510*b* (or the lower slat). This may occur, for example, when a shutter curtain formed from interlocking two or more slats 1510*a*, 1510*b* in the manner as described with reference to FIG. 15A to 15D is fully rolled out from a drum of a shutter assembly such that the shutter curtain is in the lowered state and resting on a ground. According to various embodiments, in the stacked mode, the outward curl 1520*a* of the second longitudinal edge portion 1516*a* of the first slat 1510*a* may be stacked or sit or rested on the inward curl 1520*b* of the first longitudinal edge portion 1514*b* of the second slat 1510*b* such that the first slat 1510*a* is being supported by the second slat 1510*b*.

Figure 16:
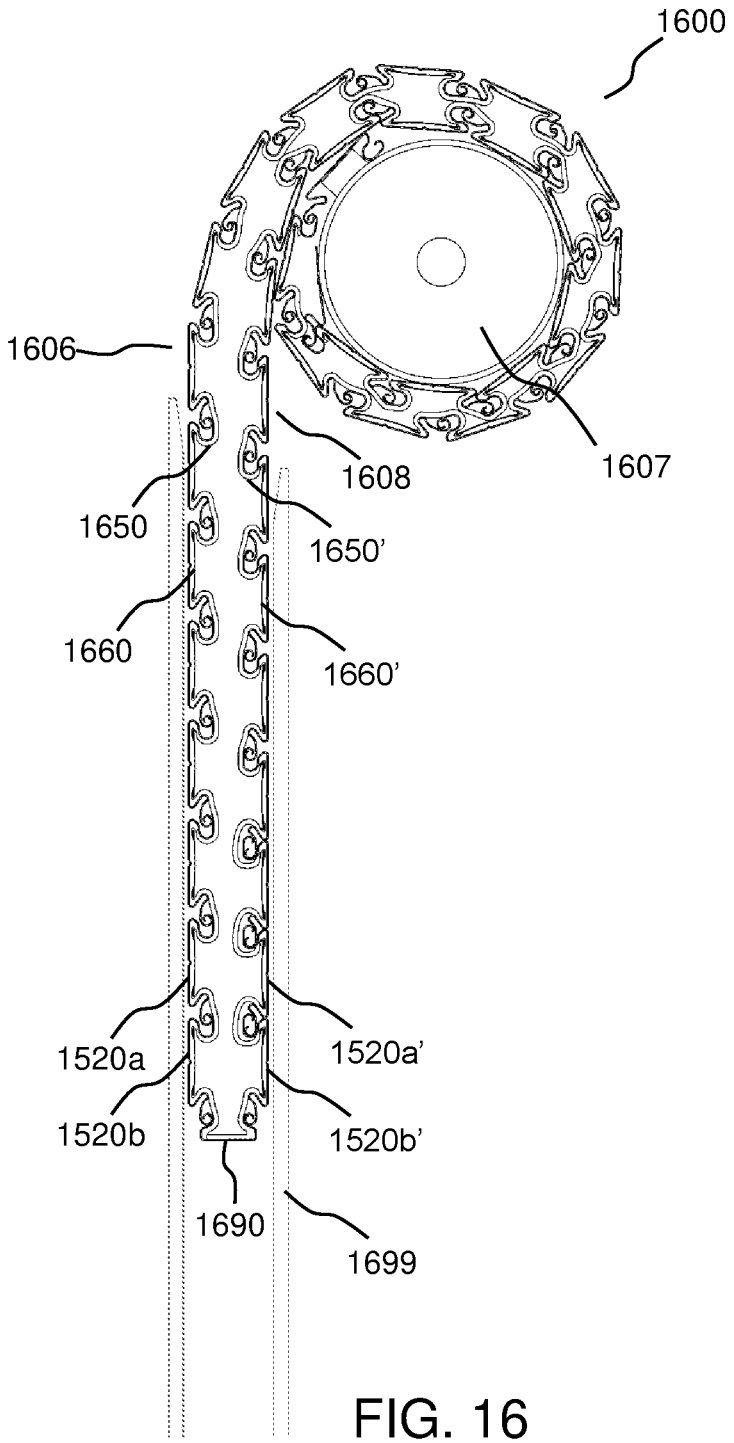
FIG. 16 shows a schematic side view of a vertical roller shutter 1600 according to various embodiments.

FIG. 16 shows a schematic side view of a vertical roller shutter 1600 according to various embodiments. As shown, the vertical roller shutter 1600 may include a pair of shutter curtain assemblies 1606, 1608. The vertical roller shutter 1600 may be configured such that the pair of shutter curtain assemblies 1606, 1608 may be raised up and lowered down vertically. Accordingly, when in the lowered state, the pair of shutter curtain assemblies 1606, 1608 may be spaced apart and parallel to each other such that the pair of shutter curtain assemblies 1606, 1608 may be facing each other. According to various embodiments, each of the pair of shutter curtain assemblies 1606, 1608 may be a shutter curtain assembly formed by the slats 1510*a*, 1510*b* of FIG. 15A to FIG. 15D. Accordingly, a plurality of slats 1510*a*, 1510*b* may be pivotally interlocked one after another to form the respective shutter curtain assembly 1606, 1608. According to various embodiments, respective insulating layers 1650, 1650' of the respective shutter curtain assemblies 1606, 1608 may be lined on respective surfaces of the respective shutter curtain assemblies 1606, 1608 such that they are facing each other.

According to various embodiments, respective retaining mechanism 1660, 1660' (similar to the retaining mechanism 160 of FIG. 1A and FIG. 1B) may be disposed on the respective insulation layer 1650, 1650' to press a portion of the respective insulation layer 1650, 1650' into respective first receiving portion of one of at least two adjacent pivotally interlocked slats and to press a further portion of the respective insulation layer 1650, 1650' into respective second receiving portion of the one of the at least two adjacent pivotally interlocked slats such that the respective retaining mechanism 1660, 1660' may cooperate with the respective first and second receiving portions of the one of the at least two adjacent pivotally interlocked slats to hold the respective insulation layer 1650, 1650' between the respective retaining mechanism 1660, 1660' and the at least two adjacent pivotally interlocked slats. According to various embodiments, the respective first and the second receiving portions of the one of the at least two adjacent pivotally interlocked slats may be a pair of bent portions of the one of the at least two adjacent pivotally interlocked slats. Each of the pair of bent portions may form an acute angle.

According to various embodiments, respective pusher members (similar to the first pusher member 170 and the second pusher member 172 of FIG. 1A and FIG. 1B) may be disposed between the respective insulation layer 1650, 1650' and the respective retaining mechanism 1660, 1660'.

According to various embodiments, the vertical roller shutter 1600 may include one single drum 1607. Accordingly, both the first shutter curtain assembly 1606 and the second shutter curtain assembly 1608 may be attached to and wound round the drum 1607. The first shutter curtain assembly 1606 and the second shutter curtain assembly 1608 may be arranged such that the respective insulating layers 1650, 1650' are facing each other when both the first shutter curtain assembly 1606 and the second shutter curtain assembly 1608 are wound round the drum 1607. According to various embodiments, the first shutter curtain assembly 1606 and the second shutter curtain assembly 1608 may be attached to the drum 1107 in a manner such that both the shutter curtain assemblies 1106, 1108 may be rolled in or rolled out at the same time in a synchronized manner.

According to various embodiments, the pair of shutter curtain assemblies 1606, 1608 may be configured such that the pair of shutter curtain assemblies 1606, 1608 operable may be operable or movable as one (or like a single unitary article).

According to various embodiments, the first shutter curtain assembly 1606 and the second shutter curtain assembly 1608 may be joined to each other at respective bottom ends by a foot component 1690 such that the pair of shutter curtain assemblies 1606, 1608 may be joined in such a way so as to form a single unit. In this manner, the pair of shutter curtain assemblies 1606, 1608 may be operable such that the pair of shutter curtain assemblies 1606, 1608 may be moved as one (or like a single unitary article). According to various embodiments, the foot component 1690 may be a substantially U-shaped channel wherein a first longitudinal side is attached to the free end of the first shutter curtain assembly 1606 and a second longitudinal side is attached to the free end of the second shutter curtain assembly 1608. According to various embodiments, the first shutter curtain assembly 1606 and the second shutter curtain assembly 1608 may be joined to each other in the manner as shown in FIG. 5B.

According to various embodiments, each of the pair of shutter curtain assemblies 1606, 1608 may be formed by the slats 1510*a*, 1510*b* of FIG. 15A to FIG. 15D. Accordingly, there may be some lateral leeway (or some degree of freedom to move laterally) between any two adjacent (or side-by-side) slats 1510*a*, 1510*b* of the respective plurality of slats such that respective two adjacent slats 1510*a*, 1510*b* may be in the suspended mode or the stacked mode (see FIG. 15A to FIG. 15D) during rolling in and rolling out depending on the position and orientation of the respective two adjacent slats 1510*a*, 1510*b*. According to various embodiments, the lateral leeway between any two adjacent slats 1510*a*, 1510*b* may provide the stackability of the plurality of slats of the respective shutter curtain assembly 1606, 1608 so as to facilitate rolling in or rolling out of the pair of curtain assemblies 1606, 1608 as a single unit. According to various embodiments, the stackability of the plurality of slats of the respective shutter curtain assembly 1606, 1608 may allow the respective shutter curtain assembly 1606, 1608 to lengthen or shorten independently so as to accommodate for the difference in length of the respective shutter curtain assembly 1606, 1608 during rolling in and rolling out due to constantly changing diameter. In particular, as one of the pair of shutter curtain assemblies 1606, 1608 may be on top of the other when wound round the drum 1607, respective length of the respective shutter curtain assembly 1606, 1608 released from the drum 1607 has to be different from each other in order for the pair of curtain assemblies 1606, 1608 to be operable or movable as a single unitary article. For example, as shown in FIG. 16, two slats 1510*a*, 1510*b* of the first shutter curtain assembly 1606 near the foot component 1690 may be in the suspended mode and two slats 1510*a'*, 1510*b'* of the second shutter curtain assembly 1608 near the foot component 1690 may be in the stacked mode. As shown, a length of the first shutter curtain assembly 1606 hanging from the drum 1607 may be longer than a length of the second shutter curtain assembly 1608 hanging from the drum 1608. Accordingly, in order to maintain the unity of the pair of shutter curtain assemblies 1606, 1608, some of the slats of the second shutter curtain assembly 1608 has to be stacked so as to accommodate the difference in length. Accordingly, the pair of shutter curtain assemblies 1606, 1608 formed by the slats 1510*a*, 1510*b* of FIG. 15A to FIG. 15D may facilitate rolling in or rolling out of the pair of curtain assemblies 1606, 1608 as a single unit.

According to various embodiments, the vertical roller shutter 1600 may include a motor assembly (not shown). According to various embodiments, a belt or a chain mechanism may couple the drum 1607 to the motor assembly such that the motor assembly may drive the rotation of the drums 1607 to roll in or roll out both the shutter curtain assemblies 1606, 1608 at the same time in a synchronized manner. Accordingly, the motor assembly may drive the drum 1607 to rotate in a first direction (for example, clockwise direction) for rolling in both the shutter curtain assemblies 1606, 1608, and drive the drum 1607 to rotate in a second direction (for example, anti-clockwise direction) for rolling out both the shutter curtain assemblies 1606, 1608.

According to various embodiments, a guide rail 1699 (or a shutter guide channel) may be provided along each sides of a wall opening in which the vertical roller shutter 1600 is installed. According to various embodiments, the pair of shutter curtain assemblies 1606, 1608 may be inserted or slotted or placed into the single guide rail 1699 (or shutter guide channel) on each sides of the wall opening such that the pair of shutter curtain assemblies 1606, 1608 may travel together as a single unit along a single guide rail 1699 on each sides of the wall opening.

Figures 17A, 17B, 17C:
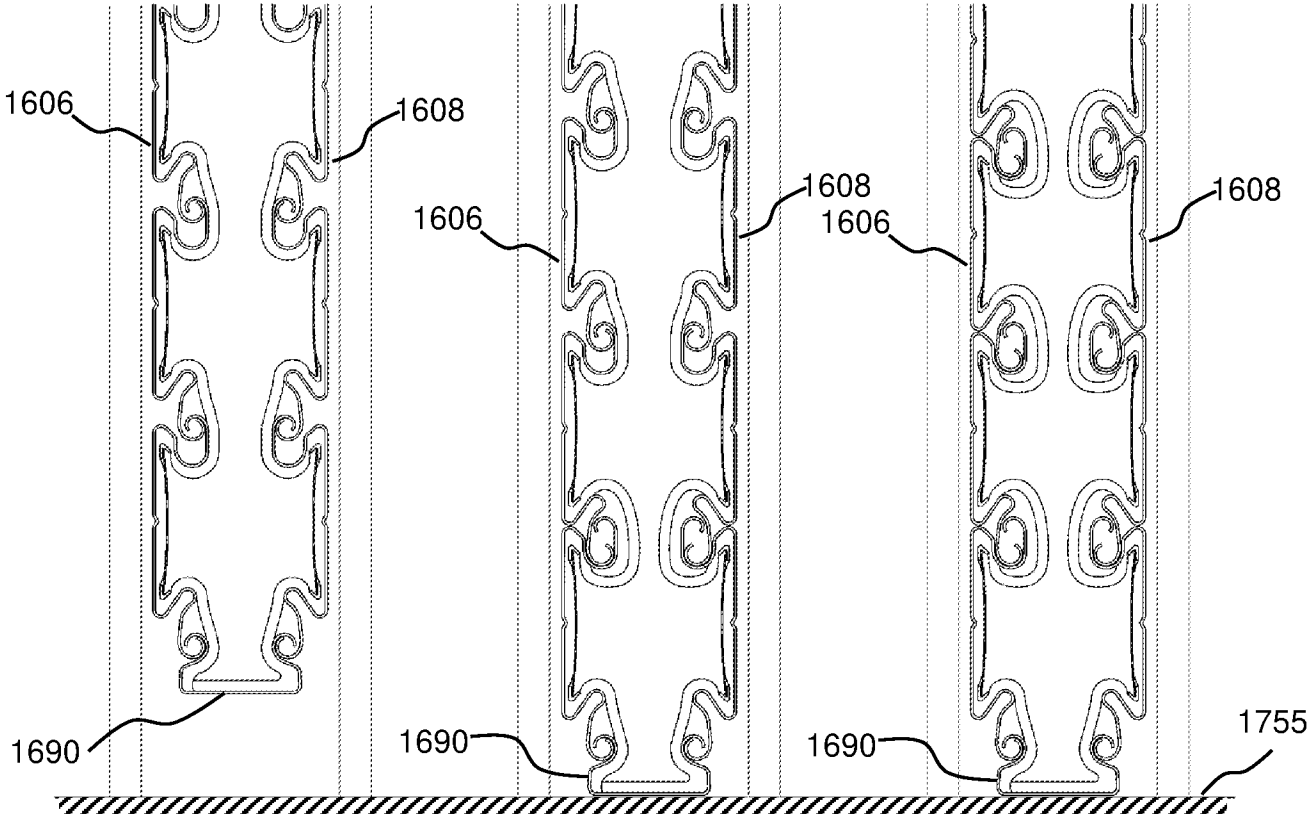
FIG. 17A to FIG. 17C show a sequence of how the plurality of slats of the respective shutter curtain assembly of the vertical roller shutter of FIG. 16 being stacked.

FIG. 17A to FIG. 17C show a sequence of how the plurality of slats of the respective shutter curtain assembly 1606, 1608 of the vertical roller shutter 1600 may continue to stack even after the foot component 1690 has reached a floor 1755 according to various embodiments. As shown in FIG. 17A, the plurality of slats of the respective shutter curtain assembly 1606, 1608 near the respective foot component 1690 may be in the suspended mode as it approaches the floor 1755. In FIG. 17B, as the respective foot component 1690 touches the floor 1755, the bottommost slats may start to stack. In FIG. 17C, as more slats are released from the drum 1607, the plurality of slats of the respective shutter curtain assembly 1606, 1608 of the vertical roller shutter 1600 may continue stacking one on top another until the respective shutter curtain assembly 1606, 1608 may form a rigid panel of firmly stacked and interlocked slats. In this manner whereby the plurality of slats are firmly stacked and interlocked, the shutter's ability to resist (or withstand) impact and/or higher wind forces may be enhanced.

According to various embodiments, while FIG. 16 and FIG. 17A to FIG. 17C show embodiments of a roller shutter with a pair of shutter curtain assemblies 1606, 1608, it is understood that a roller shutter may include two or three or more shutter curtain assemblies and may function in a fashion similar to that of the vertical roller shutter 1600 of FIG. 16. Further, it is also understood that the features of the vertical roller shutter 1600 of FIG. 16 may be applicable to lateral roller shutters.

Figure 18:
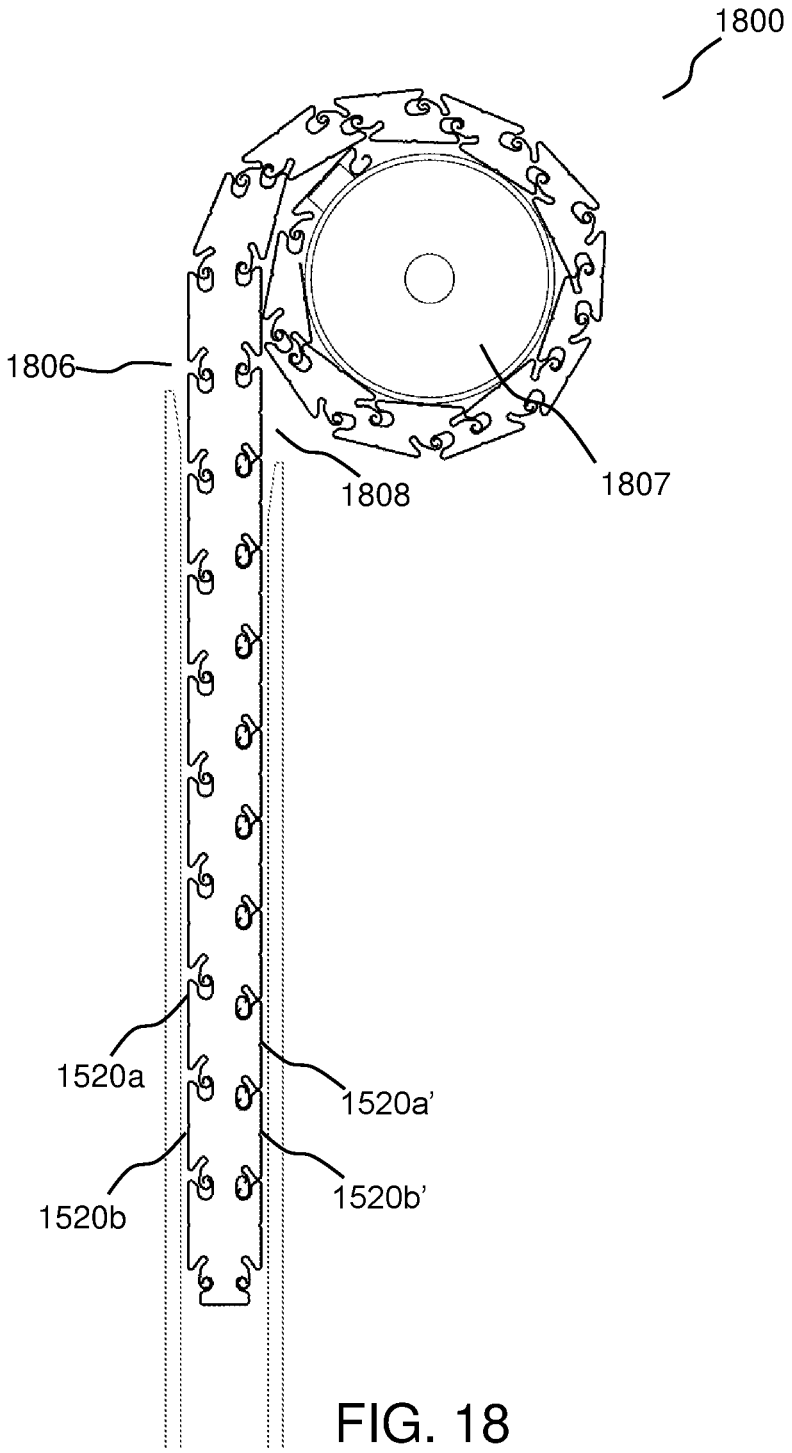
FIG. 18 shows a schematic side view of a vertical roller shutter 1800 according to various embodiments.

FIG. 18 shows a schematic side view of a vertical roller shutter 1800 according to various embodiments. The vertical roller shutter 1800 of FIG. 18 differs from the vertical roller shutter 1600 of FIG. 16 in that the vertical roller shutter 1800 of FIG. 18 does not include the insulating layers 1650, 1650' and/or the retaining mechanism 1660, 1660' and/or the pusher members. According to various embodiments, the vertical roller shutter 1800 of FIG. 18 may be a variant of the vertical roller shutter 1600 of FIG. 16 without fire insulation. According to various embodiments, the vertical roller shutter 1800 of FIG. 18 may, similar to the vertical roller shutter 1600 of FIG. 16, include a pair of shutter curtain assemblies 1806, 1808. Similarly, each of the pair of shutter curtain assemblies 1806, 1808 may be a shutter curtain assembly formed by the slats 1510*a*, 1510*b* of FIG. 15A to FIG. 15D. Accordingly, a plurality of slats 1510*a*, 1510*b* may be pivotally interlocked one after another to form the respective shutter curtain assembly 1806, 1808. According to various embodiments, the first shutter curtain assembly 1806 and the second shutter curtain assembly 1808 of the vertical roller shutter 1800 of FIG. 18 may, similar to the vertical roller shutter 1600 of FIG. 16, be joined to each other at respective bottom ends. According to various embodiments, the stackability of the respective plurality of slats of the respective shutter curtain assembly 1806, 1808 of the vertical roller shutter 1800 of FIG. 18 may allow the respective plurality of slats to be stacked into a rigid panel of firmly stacked and interlocked slats which may enhance the shutter's ability to resist (or withstand) impact and/or higher wind forces.

According to various embodiments, there is provided a slat assembly for a roller shutter. The slat assembly may include an insulation layer. The slat assembly may further include a slat having a first receiving portion and a second receiving portion. The slat may be lined with the insulation layer. The slat assembly may further include a (or at least one) retaining mechanism disposed on the insulation layer to urge a first portion of the insulation layer against the first receiving portion of the slat and to urge a second portion of the insulation layer against the second receiving portion of the slat such that the retaining mechanism may cooperate with the first and second receiving portions of the slat to hold the insulation layer between the retaining mechanism and the slat without puncturing or penetrating the insulation layer.

According to various embodiments, the first and second receiving portions of the slat may be a pair of bent portions of the slat. Each of the pair of bent portions may form an acute angle. According to various embodiments, the pair of bent portions of the slat may form a pair of grooves having a V-shaped cross-section or a U-shaped cross-section or a horse-shoe-shaped cross-section.

According to various embodiments, the retaining mechanism may press the first portion of the insulation layer into the first receiving portion of the slat and to press the second portion of the insulation layer into the second receiving portion of the slat such that the retaining mechanism cooperates with the first and second receiving portions of the slat to hold the insulation layer between the retaining mechanism and the slat.

According to various embodiments, the first and second receiving portions of the slat may extend longitudinally along the slat and may be parallel to each other.

According to various embodiments, the first and the second receiving portions of the slat may be a pair of grooves. According to various embodiments, the pair of grooves may be opposing each other. According to various embodiments, the pair of grooves is a pair of bent portions of the slat.

According to various embodiments, the slat assembly may further include a first pusher member. The first pusher member may be disposed between the first portion of the insulation layer and the retaining mechanism. The first pusher member may be aligned with a first groove of the pair of grooves. According to various embodiments, the first pusher member may include a bar with a V-shaped cross-section or a U-shaped cross-section or a horse-shoe shaped cross-section.

According to various embodiments, the slat assembly may further include a second pusher member. The second pusher member may be disposed between the second portion of the insulation layer and the retaining mechanism. The second pusher member may be aligned with a second groove of the pair of grooves. According to various embodiments, the second pusher member may include a bar with a V-shaped cross-section or a U-shaped cross-section or a horse-shoe shaped cross-section.

According to various embodiments, the retaining mechanism may be pre-loaded to supply an expansion force for urging the first and second portions of the insulation layer against the respective first and second receiving portions of the slat.

According to various embodiments, the retaining mechanism may be configured to press the first portion of the insulation layer into the first receiving portion of the slat and to press the second portion of the insulation layer into the second receiving portion of the slat.

According to various embodiments, the retaining mechanism may include an insert in the form of a strip of resilient material which may have a length longer than a distance between the first and second receiving portions of the slat.

According to various embodiments, a first longitudinal edge portion of the slat may be curled inwardly towards a longitudinal axis of the slat to form a first curled edge portion and a second longitudinal edge of the slat may be curled outwardly away from the longitudinal axis of the slat to form a second curled edge portion. According to various embodiments, the first curled edge portion may have a smaller curl radius than the second curled edge portion.

According to various embodiments, the insulation layer may include a layer of insulation wool sandwiched between two layers of insulation cloths. The insulation wool may include ceramic fiber wool or rock wool etc. The insulation cloth may include silica fabric or fibre-glass fabric etc.

According to various embodiments, the slat assembly may further include two side covers. One side cover may be attached to one end of the slat. Each side cover may be configured to cover respective edge portion of the insulation layer along the respective end of the slat.

According to various embodiments, there is provided a roller shutter. The roller shutter may include a plurality of slats pivotally interlocked one after another to form a shutter curtain. The roller shutter may further include an insulation layer lined across at least two adjacent pivotally interlocked slats of the plurality of slats. The roller shutter may further include at least one retaining mechanism disposed on the insulation layer to urge a portion of the insulation layer against a first receiving portion of one of the at least two adjacent pivotally interlocked slats and to urge a further portion of the insulation layer against a second receiving portion of the one of the at least two adjacent pivotally interlocked slats such that the at least one retaining mechanism may cooperate with the first and second receiving portions of the one of the at least two adjacent pivotally interlocked slats to hold the insulation layer between the at least one retaining mechanism and the at least two adjacent pivotally interlocked slats without puncturing or penetrating the insulation layer.

According to various embodiments, the first and second receiving portions of the one of the at least two adjacent pivotally interlocked slats may be a pair of bent portions of the one of the at least two adjacent pivotally interlocked slats. Each of the pair of bent portions may form an acute angle. According to various embodiments, the pair of bent portions of the one of the at least two adjacent pivotally interlocked slats may form a pair of parallel opposing grooves having a V-shaped cross-section or a U-shaped cross-section or a horse-shoe-shaped cross-section.

According to various embodiments, the at least one retaining mechanism may press a portion of the insulation layer into a first receiving portion of one of the at least two adjacent pivotally interlocked slats and press a further portion of the insulation layer into a second receiving portion of the one of the at least two adjacent pivotally interlocked slats such that the at least one retaining mechanism cooperates with the first and second receiving portions of the one of the at least two adjacent pivotally interlocked slats to hold the insulation layer between the at least one retaining mechanisms and the at least two adjacent pivotally interlocked slats.

According to various embodiments, the first and the second receiving portions of the one of the at least two adjacent pivotally interlocked slats may be a pair of parallel opposing grooves. According to various embodiments, the pair of parallel opposing grooves may be a pair of bent portions of the one of the at least two adjacent pivotally interlocked slats.

According to various embodiments, the roller shutter may further include at least one pusher member. The at least one pusher member may be disposed between the insulation layer and the at least one retaining mechanism. The at least one pusher member may be aligned with a groove of the pair of parallel opposing grooves of the one of the at least two adjacent pivotally interlocked slats. According to various embodiments, the at least one first pusher member may include a bar with a V-shaped cross-section or a U-shaped cross-section or horse-shoe shaped cross-section.

According to various embodiments, the at least one retaining mechanism may be pre-loaded to supply an expansion force for urging the respective portions of the insulation layer against the respective first and second receiving portions of the one of the at least two adjacent pivotally interlocked slats.

According to various embodiments, the at least one retaining mechanism may be configured to press respective portions of the insulation layer into the respective first and second receiving portion of the one of the at least two adjacent pivotally interlocked slats.

According to various embodiments, the at least one retaining mechanism may include an insert in the form of a strip of resilient material which may have a length longer than a distance between the first and second receiving portions of the one of the at least two adjacent pivotally interlocked slats.

According to various embodiments, the insulation layer may include a layer of insulation wool sandwiched between two layers of insulation cloths. The insulation wool may include ceramic fiber wool or rock wool etc. The insulation cloth may include silica fabric or fibre-glass fabric etc.

According to various embodiments, the roller shutter may include two sets of the plurality of slats to form two shutter curtains. When in the lowered state, the two shutter curtains may be spaced apart and may be directly facing each other.

According to various embodiments, foot portions of the two shutter curtains may be configured to cooperate to insulate and seal a gap between the foot portions of the two shutter curtains. According to various embodiments, the foot portions of the two shutter curtains may include insulating blocks in an overlapping arrangement to seal a gap between the foot portions of the two shutter curtains. Accordingly, one or more insulating blocks on the foot portion of a first shutter curtain may overlap one or more insulating blocks on the foot portion of a second shutter curtain.

According to various embodiments, a first shutter curtain of the two shutter curtains may be attached to a first drum which is driven by a first motor, and a second shutter curtain of the two shutter curtains may be attached to a second drum which is driven by a second motor. According to various embodiments, simultaneous driving the rotation of both the drums in a same direction in a coordinated manner may roll in or roll out both the shutter curtains at the same time in a synchronized manner.

According to various embodiments, a first shutter curtain of the two shutter curtains may be attached to a first drum which is driven by a first motor, and a second shutter curtain of the two shutter curtains may be attached to a second drum which is driven by a second motor. According to various embodiments, simultaneous driving the rotation of both the drums in opposite directions in a coordinated manner may roll in or roll out both the shutter curtains at the same time in a synchronized manner.

According to various embodiments, the two shutter curtains may be attached to one single drum which is driven by a first motor, and the two shutter curtains may be attached to the one single drum in a manner in which driving the rotation of the drum may roll in or roll out the two shutter curtains at the same time in a synchronized manner. According to various embodiments, interlocking elements of each of the plurality of slats of each shutter curtain may be configured to interlock in a manner so as to provide lateral leeway between the at least two adjacent pivotally interlocked slats (in a side-by-side configuration) such that the at least two adjacent pivotally interlocked slats may be in a suspended mode or a stacked mode. In the suspended mode, the at least two adjacent pivotally interlocked slats may be extended laterally from each other such that the respective shutter curtain may be lengthened. In the stacked mode, the at least two adjacent pivotally interlocked slats may be closed in laterally on each other such that the respective shutter curtain may be shortened. According to various embodiments, bottom ends of the two shutter curtains may be fixedly joined together such that the two shutter curtains may be joined in such a way so as to form a single unit.

According to various embodiments, there is provided a roller shutter. The roller shutter may include one single drum. The roller shutter may include two shutter curtains attached to the one single drum in a manner in which the two shutter curtains may be wound round the one single drum. Each of the two shutter curtains may include a plurality of slats pivotally interlocked one after another. Interlocking elements of each of the plurality of slats of each shutter curtain may be configured to interlock in a manner so as to provide lateral leeway between at least two adjacent pivotally interlocked slats (in a side-by-side configuration) such that the at least two adjacent pivotally interlocked slats of the respective plurality of slats may either be in a suspended mode (wherein the two slats are extended laterally from each other) or in a stacked mode (wherein the two slats are closed in laterally to stack on each other). According to various embodiments, the two shutter curtains may be fixedly joined together at respective bottom ends of respective shutter curtain.

According to various embodiments, the roller shutter may further include an insulation layer lined across the plurality of slats of the respective shutter curtain. According to various embodiments, the roller shutter may further include at least one retaining mechanism disposed on the insulation layer to urge a first portion of the insulation layer against a first receiving portion of one of the plurality of slats of the respective shutter curtain and to urge a second portion of the insulation layer against a second receiving portion of the one of the plurality of slats of the respective shutter curtain such that the at least one retaining mechanism may cooperate with the first and second receiving portions of the one of the plurality of slats of the respective shutter curtain to hold the insulation layer between the at least one retaining mechanism and the plurality of slats of the respective shutter curtain without puncturing or penetrating the insulation layer.

According to various embodiments, the roller shutter may further include a first pusher member disposed between the first portion of the insulation layer and a first end of the at least one retaining mechanism. According to various embodiments, the roller shutter may further include a second pusher member disposed between the second portion of the insulation layer and a second end of the at least one retaining mechanism.

According to various embodiments, the first and the second receiving portions of the one of the at least two adjacent pivotally interlocked slats may be a pair of bent portions of the one of the at least two adjacent pivotally interlocked slats. Further, each of the pair of bent portions may be of an acute angle. According to various embodiments, the pair of bent portions of the one of the at least two adjacent pivotally interlocked slats may form a pair of parallel opposing grooves. According to various embodiments, the first and the second pusher member may be aligned to corresponding grooves.

According to various embodiments, there is provided a method of manufacturing a slat assembly. The method may include providing a slat having a first receiving portion and a second receiving portion. The method may further include lining an insulation layer on the slat. The method may further include disposing a (or at least one) retaining mechanism on the insulation layer to urge a first portion of the insulation layer against the first receiving portion of the slat and to urge a second portion of the insulation layer against the second receiving portion of the slat such that the retaining mechanism may cooperate with the first and second receiving portions of the slat to hold the insulation layer between the retaining mechanism and the slat without puncturing or penetrating the insulation layer.

According to various embodiments, the first and second receiving portions of the slat may be a pair of bent portions of the slat. Each of the pair of bent portions may form an acute angle.

According to various embodiments, the retaining mechanism may press a first portion of the insulation layer into the first receiving portion of the slat and press a second portion of the insulation layer into the second receiving portion of the slat such that the retaining mechanism cooperates with the first and second receiving portions of the slat to hold the insulation layer between the retaining mechanism and the slat.

According to various embodiments, the method may further include configuring the slat assembly according to the various embodiments as described herein.

According to various embodiments, there is provided a method of a roller shutter. The method may include providing a plurality of slats pivotally interlocked one after another to form a shutter curtain. The method may further include lining an insulation layer across at least two adjacent pivotally interlocked slats of the plurality of slats. The method may further include disposing at least one retaining mechanism on the insulation layer to urge a portion of the insulation layer against a first receiving portion of one of the at least two adjacent pivotally interlocked slats and to urge a further portion of the insulation layer against a second receiving portion of the one of the at least two adjacent pivotally interlocked slats such that the at least one retaining mechanism may cooperate with the first and second receiving portions of the one of the at least two adjacent pivotally interlocked slats to hold the insulation layer between the retaining mechanism and the at least two adjacent pivotally interlocked slats without puncturing or penetrating the insulation layer.

According to various embodiments, the first and second receiving portions of the one of the at least two adjacent pivotally interlocked slats may be a pair of bent portions of the one of the at least two adjacent pivotally interlocked slats. Each of the pair of bent portions may form an acute angle.

According to various embodiments, the at least one retaining mechanism may press a portion of the insulation layer into a first receiving portion of one of the at least two adjacent pivotally interlocked slats and may press a further portion of the insulation layer into a second receiving portion of the one of the at least two adjacent pivotally interlocked slats such that the at least one retaining mechanism cooperates with the first and second receiving portions of the one of the at least two adjacent pivotally interlocked slats to hold the insulation layer between the at least one retaining mechanism and the at least two adjacent pivotally interlocked slats.

According to various embodiments, the method may further include configuring the roller shutter according to the various embodiments as described herein.

Various embodiments have provided a fire-insulated shutter curtain assembly or a fire-insulated roller shutter which include an insulation layer secured or attached or fastened to a shutter curtain of a roller shutter without puncturing or penetrating the insulation layer with fasteners. Accordingly, the fire-insulated shutter curtain assembly or the fire-insulated roller shutter may be free of any fasteners that may form a "thermal bridge" through the insulation layer. Hence, the insulation layer may be intact and the thermal insulation integrity of the insulation layer may be fully preserved such that the insulation layer may be effective in providing insulation to the shutter curtain or the roller shutter. At the same time, the insulation layer may be properly secured, attached or fastened to the shutter curtain such that the insulation layer may be rolled or unrolled together with the shutter curtain in a manner which minimizes or eliminates misalignment or bulging or tearing or over-stretching of the insulation layer.

While the invention has been particularly shown and described with reference to specific embodiments, it should be understood by those skilled in the art that various changes, modification, variation in form and detail may be made therein without departing from the scope of the invention as defined by the appended claims. The scope of the invention is thus indicated by the appended claims and all changes which come within the meaning and range of equivalency of the claims are therefore intended to be embraced.

The invention claimed is:

1. A slat assembly for a roller shutter, the slat assembly comprising:

a slat having a first receiving portion and a second receiving portion, wherein the first and second receiving portions of the slat are a pair of bent portions of the slat, each of the pair of bent portions forming an acute angle;

an insulation layer lined across the slat and extending beyond the first receiving portion and the second receiving portion of the slat;

and a retaining mechanism having a first end and a second end, the first and second ends being opposite ends of the retaining mechanism, wherein the retaining mechanism is disposed on the insulation layer with the first end pressing a first portion of the insulation layer into the first receiving portion of the slat to sandwich the first portion of the insulation layer between the first end of the retaining mechanism and the first receiving portion of the slat and the second end pressing a second portion of the insulation layer into the second receiving portion of the slat to sandwich the second portion of the insulation layer between the second end of the retaining mechanism and the second receiving portion of the slat such that the first and second ends of the retaining mechanism respectively cooperates with the first and second receiving portions of the slat to sandwich the insulation layer between the retaining mechanism and the slat without the retaining mechanism being in contact with the slat, wherein the retaining mechanism is pre-loaded to supply an expansion force for the first and second ends of the retaining mechanism to respectively urge the first and second portions of the insulation layer against the respective first and second receiving portions of the slat.

2. The assembly as claimed in claim 1, wherein the first and second receiving portions of the slat extend longitudinally along the slat and are parallel to each other.

3. The slat assembly as claimed in claim 1, wherein the retaining mechanism comprises an insert in the form of a strip of resilient material which has a length longer than a distance between the first and second receiving portions of the slat.

4. The slat assembly as claimed in claim 1, wherein a first longitudinal edge portion of the slat is curled inwardly towards a longitudinal axis of the slat to form a first curled edge portion and a second longitudinal edge of the slat is curled outwardly away from the longitudinal axis of the slat to form a second curled edge portion, wherein the first curled edge portion has a smaller curl radius than the second curled edge portion.

5. The assembly as claimed in claim 1, wherein the pair of bent portions of the slat forms a pair of grooves having a V-shaped cross-section or a U-shaped cross-section or a horse-shoe-shaped cross-section, wherein the pair of grooves is opposing each other.

6. The slat assembly as claimed in claim 5, further comprising a first pusher member, wherein the first pusher member is disposed between the first portion of the insulation layer and the retaining mechanism, and wherein the first pusher member is aligned with a first groove of the pair of grooves.

7. The slat assembly as claimed in claim 5, further comprising a second pusher member, wherein the second pusher member is disposed between the second portion of the insulation layer and the retaining mechanism, and wherein the second pusher member is aligned with a second groove of the pair of grooves.

8. A roller shutter comprising:

a plurality of slats pivotally interlocked one after another to form a shutter curtain;

an insulation layer lined and extending across at least two adjacent pivotally interlocked slats of the plurality of slats;

at least one retaining mechanism having a first end and a second end, the first and second ends being opposite ends of the at least one retaining mechanism, wherein the at least one retaining mechanism is disposed on the insulation layer with the first end pressing a portion of the insulation layer into a first receiving portion of one of the at least two adjacent pivotally interlocked slats to sandwich the portion of the insulation layer between the first end of the at least one retaining mechanism and the first receiving portion of the one of the at least two adjacent pivotally interlocked slats and the second end pressing a further portion of the insulation layer into a second receiving portion of the one of the at least two adjacent pivotally interlocked slats to sandwich the further portion of the insulation layer between the second end of the at least one retaining mechanism and the second receiving portion of the one of the at least two adjacent pivotally interlocked slats such that the first and second ends of the at least one retaining mechanism cooperates with the first and second receiving portions of the one of the at least two adjacent pivotally interlocked slats to sandwich the insulation layer between the at least one retaining mechanism and the at least two adjacent pivotally interlocked without the at least one retaining mechanism being in contact with the at least two adjacent pivotally interlocked slats, wherein the first and the second receiving portions of the one of the at least two adjacent pivotally interlocked slats are a pair of bent portions of the one of the at least two adjacent pivotally interlocked slats, each of the pair of bent portions forming an acute angle, wherein the at least one retaining mechanism is pre-loaded to supply an expansion force for the first and second ends of the at least one retaining mechanism to urge the respective portions of the insulation layer against the respective first and second receiving portions of the one of the at least two adjacent pivotally interlocked slats.

9. The roller shutter as claimed in claim 8, wherein the at least one retaining mechanism comprises an insert in the form of a strip of resilient material which has a length longer than a distance between the first and second receiving portions of the one of the at least two adjacent pivotally interlocked slats.

10. The roller shutter as claimed in claim 8, wherein the pair of bent portions of the one of the at least two adjacent pivotally interlocked slats forms a pair of parallel opposing grooves having a V-shaped cross-section or a U-shaped cross-section or a horse-shoe-shaped cross-section.

11. The roller shutter as claimed in claim 10, further comprising at least one pusher member, wherein the at least one pusher member is disposed between the insulation layer and the at least one retaining mechanism, and wherein the at least one pusher member is aligned with a groove of the pair of parallel opposing grooves of the one of the at least two adjacent pivotally interlocked slats.

12. The roller shutter as claimed in claim 8, wherein the roller shutter comprises two sets of the plurality of slats to form two shutter curtains, wherein, when in the lowered state, the two shutter curtains are spaced apart and facing each other.

13. The roller shutter as claimed in claim 12, wherein foot portions of the two shutter curtains comprise insulating blocks in an overlapping arrangement to seal a gap between the foot portions of the two shutter curtains.

14. The roller shutter as claimed in claim 12, wherein a first shutter curtain of the two shutter curtains is attached to a first drum which is driven by a first motor, and a second shutter curtain of the two shutter curtains is attached to a second drum which is driven by a second motor, wherein simultaneous driving the rotation of both the drums in a same direction or in opposite directions in a coordinated manner rolls in or rolls out both the shutter curtains at the same time in a synchronized manner.

15. The roller shutter as claimed in claim 12, wherein the two shutter curtains are attached to one single drum which is driven by a first motor, and the two shutter curtains are attached to the one single drum in a manner in which driving the rotation of the drum rolls in or rolls out the two shutter curtains at the same time in a synchronized manner.

16. The roller shutter as claimed in claim 15, wherein interlocking elements of each of the plurality of slats of each shutter curtain are configured to interlock in a manner so as to provide lateral leeway between the at least two adjacent pivotally interlocked slats such that the at least two adjacent pivotally interlocked slats may be in a suspended mode or a stacked mode, and wherein bottom ends of the two shutter curtains are fixedly joined together.

17. A method of manufacturing a slat assembly, the method comprising:

providing a slat having a first receiving portion and a second receiving portion, wherein the first and second receiving portions of the slat are a pair of bent portions of the slat, each of the pair of bent portions forming an acute angle;

lining an insulation layer across the slat such that the insulation layer extends beyond the first receiving portion and the second receiving portion of the slat; and disposing a retaining mechanism having a first end and a second end on the insulation layer with the first end pressing a first portion of the insulation layer into the first receiving portion of the slat to sandwich the first portion of the insulation layer between the first end of the retaining mechanism and the first receiving portion of the slat and the second end pressing a second portion of the insulation layer into the second receiving portion of the slat to sandwich the second portion of the insulation layer between the second end of the retaining mechanism and the second receiving portion of the slat such that the first and second ends of the retaining mechanism cooperates with the first and second receiving portions of the slat to sandwich the insulation layer between the retaining mechanism and the slat without the retaining mechanism being in contact with the slat, wherein the first and second ends are opposite ends of the retaining mechanism, wherein the retaining mechanism is pre-loaded to supply an expansion force for the first and second ends of the retaining mechanism to respectively urge the first and second portions of the insulation layer against the respective first and second receiving portions of the slat.

18. A method of manufacturing a roller shutter, the method comprising:

providing a plurality of slats pivotally interlocked one after another to form a shutter curtain;

lining an insulation layer to extend across at least two adjacent pivotally interlocked slats of the plurality of slats;

disposing at least one retaining mechanism having a first end and a second end on the insulation layer with the first end pressing a portion of the insulation layer into a first receiving portion of one of the at least two adjacent pivotally interlocked slats to sandwich the portion of the insulation layer between the first end of the at least one retaining mechanism and the first receiving portion of the one of the at least two adjacent pivotally interlocked slats and the second end pressing a further portion of the insulation layer into a second receiving portion of the one of the at least two adjacent pivotally interlocked slats to sandwich the further portion of the insulation layer between the second end of the at least one retaining mechanism and the second receiving portion of the one of the at least two adjacent pivotally interlocked slats such that the first and second ends of the at least one retaining mechanism cooperates with the first and second receiving portions of the one of the at least two adjacent pivotally interlocked slats to sandwich the insulation layer between the at least one retaining mechanism and the at least two adjacent pivotally interlocked slats without the at least one retaining mechanism being in contact with the at least two adjacent pivotally interlocked slats, wherein the first and second receiving portions of the one of the at least two adjacent pivotally interlocked slats are a pair of bent portions of the one of the at least two adjacent pivotally interlocked slats, each of the pair of bent portions forming an acute angle, wherein the first and second ends of the at least one retaining mechanism are opposite ends of the at least one retaining mechanism, wherein the at least one retaining mechanism is preloaded to supply an expansion force for the first and second ends of the at least one retaining mechanism to urge the respective portions of the insulation layer against the respective first and second receiving portions of the one of the at least two adjacent pivotally interlocked slats.

* * * * *